US010637185B2

(12) United States Patent
Mori

(10) Patent No.: US 10,637,185 B2
(45) Date of Patent: Apr. 28, 2020

(54) CONNECTOR AND ELECTRIC WIRE WITH CONNECTOR

(71) Applicant: Yazaki Corporation, Tokyo (JP)

(72) Inventor: Yuki Mori, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/219,389

(22) Filed: Dec. 13, 2018

(65) Prior Publication Data

US 2019/0190192 A1 Jun. 20, 2019

(30) Foreign Application Priority Data

Dec. 20, 2017 (JP) ..... 2017-243328

(51) Int. Cl.

| | |
|---|---|
| ***H01R 13/62*** | (2006.01) |
| ***H01R 13/621*** | (2006.01) |
| ***H01R 13/6581*** | (2011.01) |
| *H01R 13/533* | (2006.01) |
| *H01R 13/52* | (2006.01) |
| *H01R 13/627* | (2006.01) |
| *H01R 24/20* | (2011.01) |
| *H01R 103/00* | (2006.01) |

(52) U.S. Cl.

CPC ..... *H01R 13/621* (2013.01); *H01R 13/6581* (2013.01); *H01R 13/521* (2013.01); *H01R 13/533* (2013.01); *H01R 13/627* (2013.01); *H01R 13/6215* (2013.01); *H01R 24/20* (2013.01); *H01R 2103/00* (2013.01)

(58) Field of Classification Search

CPC ..... H01R 13/621; H01R 13/6581; H01R 13/521; H01R 13/533

USPC ..... 439/564

See application file for complete search history.

(56) References Cited

U.S. PATENT DOCUMENTS

| | | | | |
|---|---|---|---|---|
| 8,414,330 | B2 * | 4/2013 | Yamada | H01R 13/4226 439/579 |
| 8,827,569 | B2 * | 9/2014 | Yamada | H01R 13/621 385/56 |
| 9,065,194 | B2 * | 6/2015 | Suzuki | H01R 4/34 |

(Continued)

FOREIGN PATENT DOCUMENTS

| | | | |
|---|---|---|---|
| JP | 2003-308930 | A | 10/2003 |
| JP | 2016-192316 | A | 11/2016 |
| JP | 2017-004863 | A | 1/2017 |

*Primary Examiner* — Alexander Gilman

(74) *Attorney, Agent, or Firm* — Sughrue Mion, PLLC

(57) ABSTRACT

A connector includes: an electrical connection part to be electrically connected to a counterpart terminal and an electric wire connection part to be electrically connected to a terminal of an electric wire; a housing body that is insulative, houses the electrical connection part in an inward housing space and causes the electric wire connection part to project outward; a first shielding member that is conductive and includes a main shield body that covers the housing body from the outside, and a sub-shield body having a tubular shape that covers the electric wire connection part and the terminal of the electric wire We from the outside for each terminal metal fitting; and a second shielding member having a tubular shape, electrical conductivity, and elasticity that covers, from the outside, an end part on an opening side of the sub-shield body together with the electric wire pulled out from the opening.

5 Claims, 21 Drawing Sheets

(56) References Cited

U.S. PATENT DOCUMENTS

| | | | | |
|---|---|---|---|---|
| 9,438,000 | B2 * | 9/2016 | Kato | H01R 9/037 |
| 9,862,337 | B2 * | 1/2018 | Inao | H02G 3/0462 |
| 10,014,600 | B1 * | 7/2018 | Mori | H01R 9/0518 |
| 10,135,175 | B2 * | 11/2018 | Aoshima | H01R 13/025 |
| 10,211,570 | B2 * | 2/2019 | Tanaka | H01R 13/6215 |
| 10,256,576 | B2 * | 4/2019 | Takahashi | H01R 13/40 |
| 2015/0340801 | A1 * | 11/2015 | Tashiro | H01R 13/506 439/587 |

* cited by examiner

CONNECTOR AND ELECTRIC WIRE WITH CONNECTOR

CROSS-REFERENCE TO RELATED APPLICATION(S)

The present application claims priority to and incorporates by reference the entire contents of Japanese Patent Application No. 2017-243328 filed in Japan on Dec. 20, 2017.

BACKGROUND OF THE INVENTION

1. Field of the Invention

The present invention relates to a connector and an electric wire with a connector.

2. Description of the Related Art

In the related art, a connector includes a terminal metal fitting and an insulative housing body housing the terminal metal fitting, and the housing body is engaged with a housing of a counterpart connector to electrically connect the terminal metal fitting to a counterpart terminal metal fitting of the counterpart connector. Such a type of connector is disclosed in Japanese Patent Application Laid-open No. 2017-004863, for example. In the connector disclosed in Japanese Patent Application Laid-open No. 2017-004863, to prevent noise from entering a terminal metal fitting or an electric wire, a plurality of terminal metal fittings are covered with one shield shell for each housing body, and electric wires are tied up in a bundle and covered with one braid for each terminal metal fitting.

In a connector in the related art, electric wires are tied up in a bundle, so that thermal interference may be generated between the electric wires. For example, the thermal interference between the electric wires may become a cause of lowering of durability of the electric wire. Thus, in the connector in the related art, a diameter of the electric wire is increased to avoid influence of thermal interference. However, in the connector in the related art, a degree of freedom of a routing path of the electric wires can be hardly improved because the electric wires are tied up in a bundle, and improvement allowance for the degree of freedom of the routing path is further reduced when the diameter of the electric wire is required to be increased.

SUMMARY OF THE INVENTION

A purpose of the present invention is to provide a connector and an electric wire with a connector that can prevent thermal interference from being generated between electric wires.

According to an aspect of the present invention, a connector includes: a terminal metal fitting that includes an electrical connection part to be electrically connected to a counterpart terminal of a counterpart connector and an electric wire connection part to be electrically connected to a terminal of an electric wire; a housing body that is insulative, houses the electrical connection part in an inward housing space, and causes the electric wire connection part to project outward; a first shielding member that is conductive and includes a main shield body that covers the housing body from the outside, and a sub-shield body having a tubular shape that covers the electric wire connection part and the terminal of the electric wire from the outside for each terminal metal fitting; and a second shielding member having a tubular shape, electrical conductivity, and elasticity that covers, from the outside, an end part on an opening side of the sub-shield body together with the electric wire pulled out from the opening.

According to another aspect of the present invention, the connector may include a binding member that is wound around the second shielding member and the end part on the opening side of the sub-shield body over the second shielding member to fix the second shielding member to the end part on the opening side of the sub-shield body. The sub-shield body may include a locking body that projects from an outer peripheral surface of the end part on the opening side, and the binding member having an annular shape after winding is arranged to be opposed to an end face on the main shield body side of the locking body in a tube axis direction of the sub-shield body.

According to still another aspect of the present invention, the connector may include a holding member that prevents, on the electric wire side, the terminal metal fitting from falling out from the housing body. The holding member may have a cylindrical outer peripheral wall to which the end part on the opening side of the sub-shield body having a cylindrical shape is fitted, and be formed to be able to pull out, to the outside, the electric wire routed in a housing space inside the sub-shield body, the outer peripheral wall may include a gap into which the locking body is inserted in a state in which the holding member is engaged with the end part on the opening side of the sub-shield body, and the locking body and the gap may be formed and arranged to be able to prevent relative rotation in a circumferential direction of the sub-shield body and the holding member.

According to still another aspect of the present invention, an electric wire with a connector includes: an electric wire; a terminal metal fitting that includes an electrical connection part to be electrically connected to a counterpart terminal of a counterpart connector and an electric wire connection part to be electrically connected to a terminal of the electric wire; a housing body that is insulative, houses the electrical connection part in an inward housing space, and causes the electric wire connection part to project outward; a first shielding member that is conductive and includes a main shield body that covers the housing body from the outside, and a sub-shield body having a tubular shape that covers the electric wire connection part and the terminal of the electric wire from the outside for each terminal metal fitting; and a second shielding member having a tubular shape, electrical conductivity, and elasticity that covers, from the outside, an end part on an opening side of the sub-shield body together with the electric wire pulled out from the opening.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
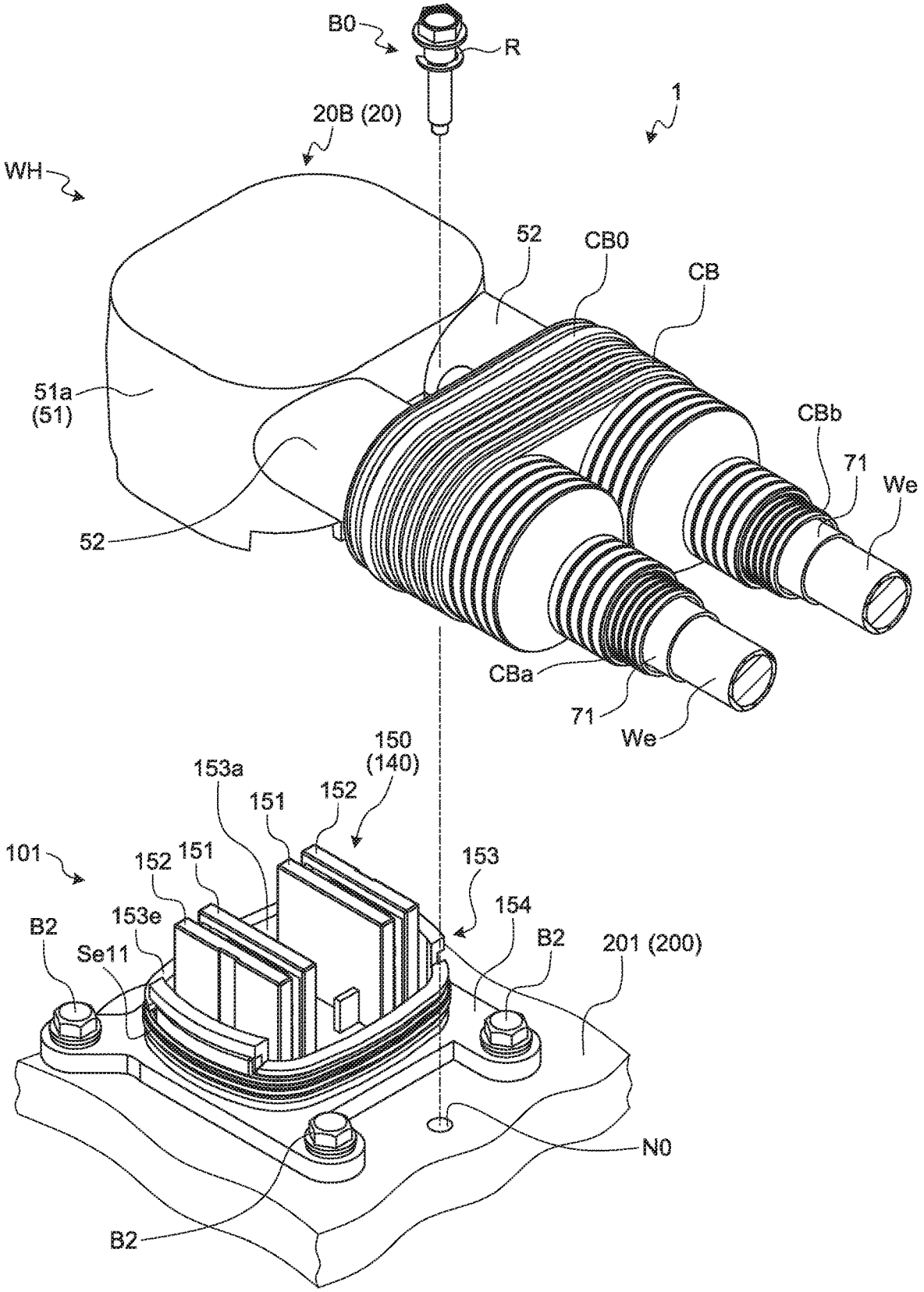
FIG. 1 is a perspective view illustrating a connector and an electric wire with a connector according to an embodiment together with a counterpart connector before connector engagement.

The following describes an embodiment of a connector and an electric wire with a connector according to the present invention in detail based on the drawings. The present invention is not limited to the embodiment.

Embodiment

The following describes an embodiment of the connector and the electric wire with a connector according to the present invention based on FIGS. 1 to 24.

The reference numeral 1 in FIGS. 1 to 4 denotes a connector according to the present embodiment. The reference sign WH in FIGS. 1 to 4 denotes an electric wire with a connector in which the connector 1 is attached to an electric wire We in a state of being electrically connected thereto.

The connector 1 constitutes a connector device together with a counterpart connector 101 (FIG. 1). The connector device is a device that electrically connects connection objects that are respectively electrically connected to a first connector and a second connector by physically and electrically connecting the first connector with the second connector. For convenience, the connector 1 is assumed to be the first connector, and the counterpart connector 101 is assumed to be the second connector herein.

For example, the connection object indicates a power supply circuit such as an inverter, an electric appliance such as a rotary machine, and the like. For example, the connector 1 is electrically connected to an electric appliance (not illustrated) via the electric wire We. On the other hand, the counterpart connector 101 is attached to a housing 201 of a power supply circuit 200 (FIG. 1), and electrically connected to the power supply circuit 200 via an electric wire (not illustrated). When the connector 1 and the counterpart connector 101 are electrically connected to each other, the electric appliance can be electrically connected to the power supply circuit 200, and electric power can be supplied to the electric appliance from a power supply (a secondary cell and the like), or a power supply can be charged with electric power generated by the electric appliance.

The connector 1 according to the present embodiment is inserted into and engaged with the counterpart connector 101 to be electrically connected thereto. On the other hand, when the connector 1 is removed from the counterpart connector 101, the connector 1 is electrically disconnected from the counterpart connector 101. Herein, an inserting and engaging direction thereof is referred to as a "connector inserting direction", and a removing direction thereof is referred to as a "connector removing direction". In a case of not specifying both directions, they are referred to as a "connector inserting and removing direction". Each direction indicates a direction with respect to the counterpart connector 101 of the connector 1 in a case of mainly explaining the connector 1, and indicates a direction with respect to the connector 1 of the counterpart connector 101 in a case of mainly explaining the counterpart connector 101.

The connector 1 according to the present embodiment may be any of a female connector including a female terminal and a male connector including a male terminal so long as the connector 1 has a configuration that is described in detail below. In the following example, the connector 1 is described as the male connector, and the counterpart connector 101 is described as the female connector.

Figure 4:
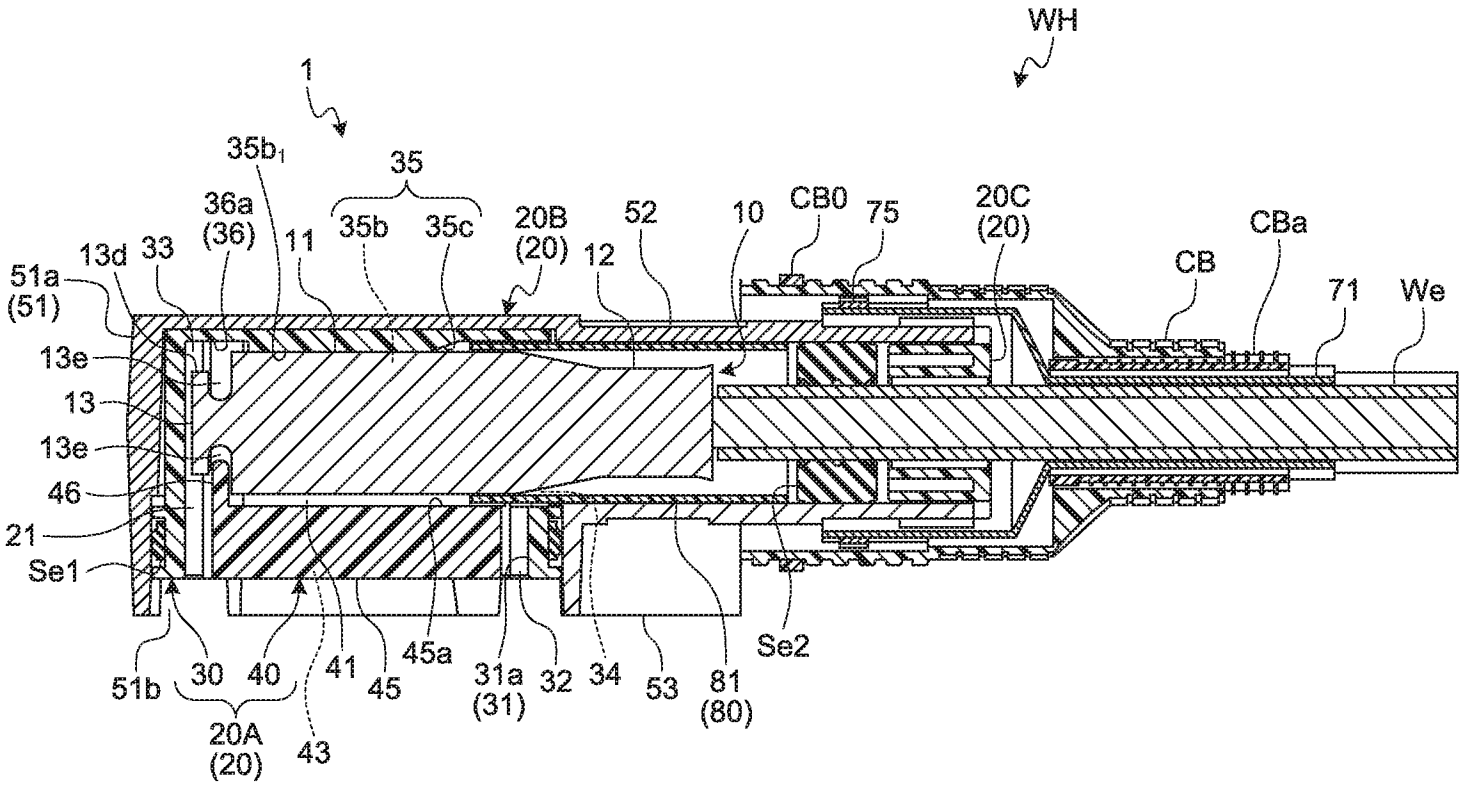
FIG. 4 is a cross-sectional view along the line X1-X1 in FIG. 3.
Figure 5:
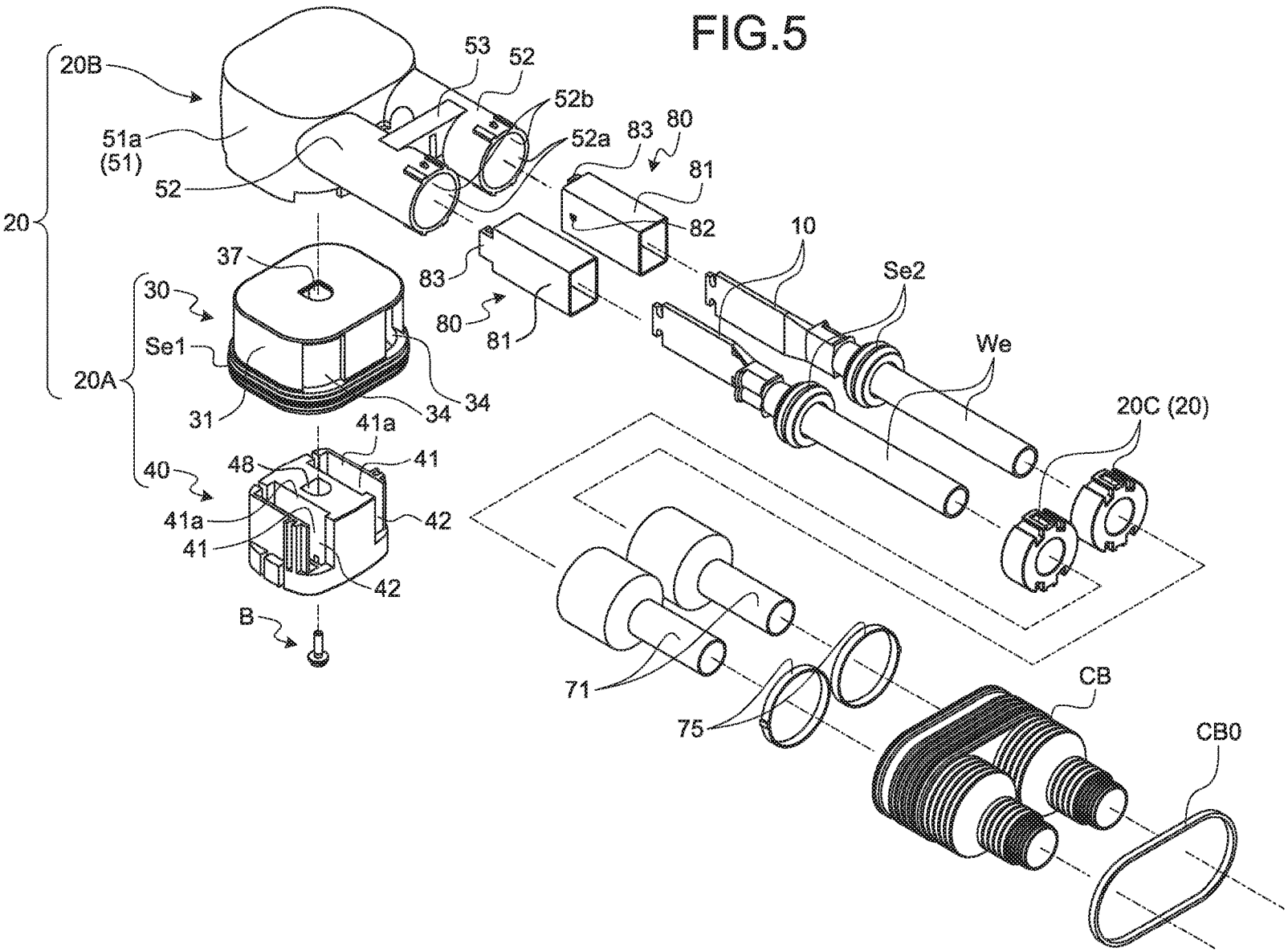
FIG. 5 is an exploded perspective view illustrating the connector according to the embodiment together with the electric wire.
Figure 6:
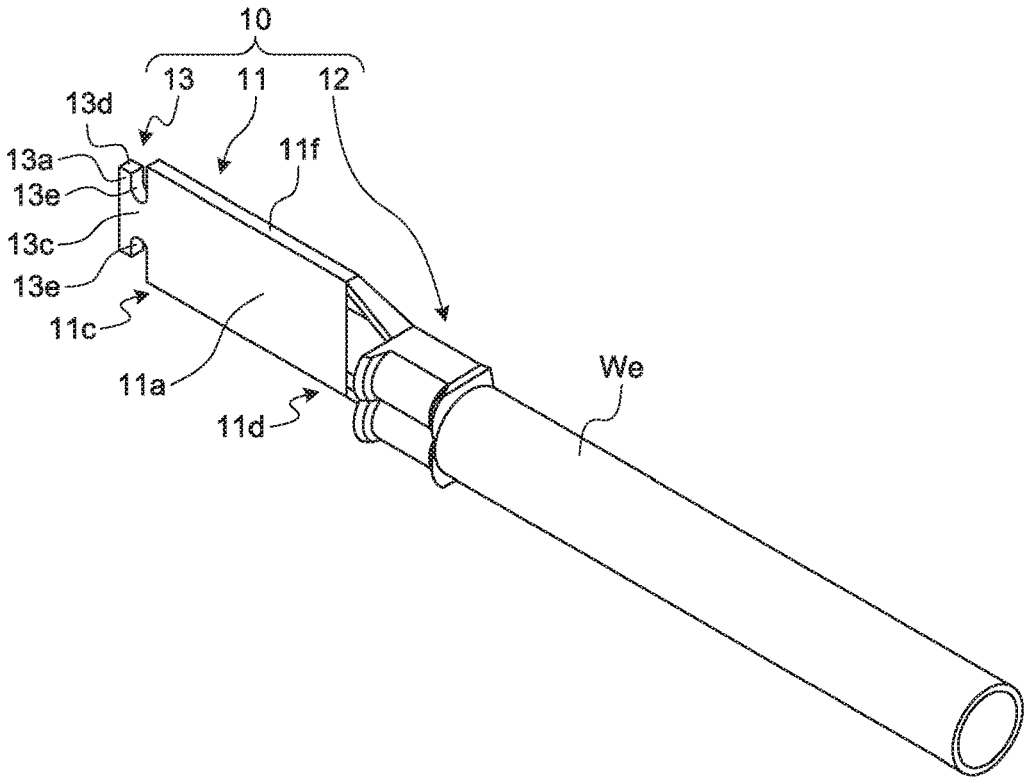
FIG. 6 is a perspective view illustrating a terminal metal fitting attached to the electric wire.
Figure 7:
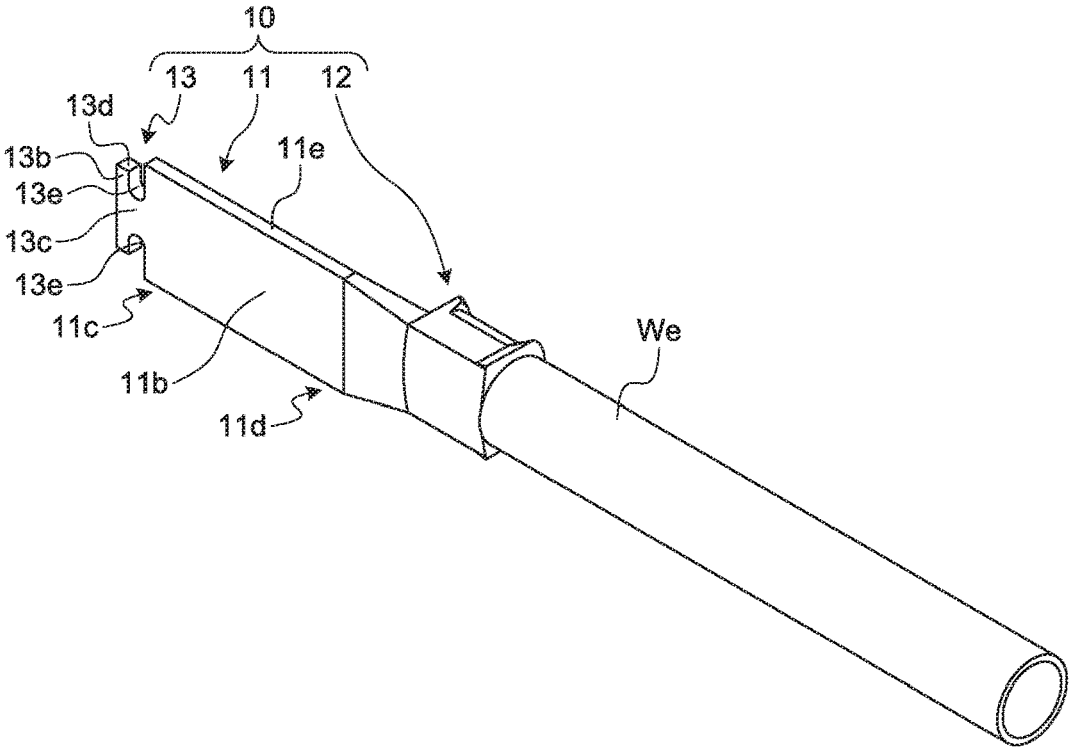
FIG. 7 is a perspective view of the terminal metal fitting attached to the electric wire viewed from a different angle.

The connector 1 according to the present embodiment includes a terminal metal fitting 10 and a housing 20 (FIGS. 4 and 5).

The terminal metal fitting 10 according to the present embodiment is formed in a male shape with a conductive material such as metal (copper, copper alloy, aluminum, aluminum alloy, and the like). In this example, a conductive metal plate is used as a base material, and the terminal metal fitting 10 having a male shape is formed by press working such as cutting and bending. The terminal metal fitting 10 includes an electrical connection part 11 that is electrically connected to a counterpart terminal 110 (described later) of the counterpart connector 101, and an electric wire connection part 12 that is electrically connected to a terminal of the electric wire We (FIGS. 4, and 6 to 9).

Figure 9:
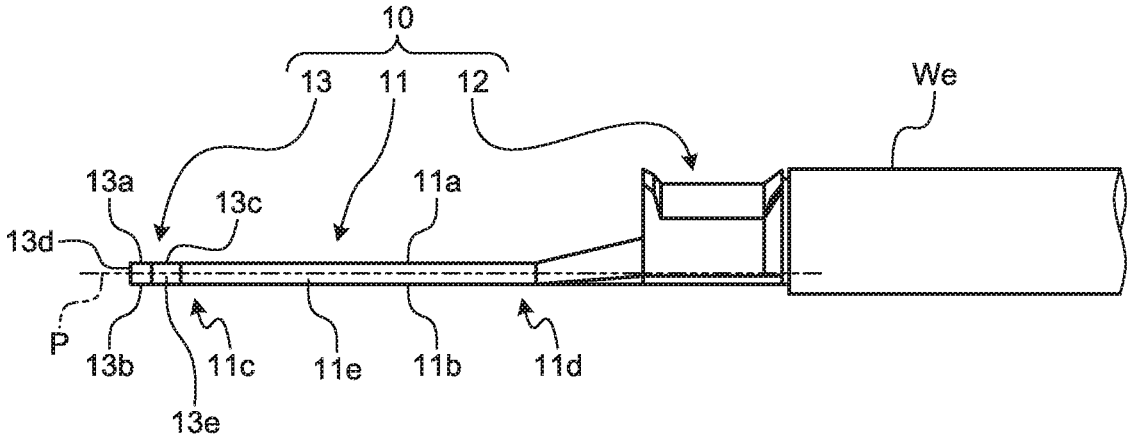
FIG. 9 is a side view of the terminal metal fitting attached to the electric wire viewed from a first end face side.

The exemplified electrical connection part 11 is formed in a male shape. The electrical connection part 11 is formed in a flat plate shape including two flat wall surfaces (a first wall surface 11*a*, a second wall surface 11*b*) (FIG. 9). Herein, the electrical connection part 11 is formed in a rectangular flat plate shape in which the first wall surface 11*a* and the second wall surface 11*b* are arranged in parallel to be opposed to each other. The electrical connection part 11 utilizes at least one of the first wall surface 11*a* and the second wall surface 11*b* as a contact part that is physically and electrically connected to the counterpart terminal 110. Herein, as described later, the counterpart terminal 110 includes two electrical connection parts (a first electrical connection part 121, a second electrical connection part 122), so that the first wall surface 11*a* and the second wall surface 11*b* are utilized as contact parts to be electrically connected to the respective electrical connection parts.

The exemplified electric wire connection part 12 is physically and electrically connected to the terminal of the electric wire We. The electric wire connection part 12 may be crimped to the terminal of the electric wire We by caulking and the like, or may be fixed thereto by welding and the like. The exemplified electric wire connection part 12 is crimped to the terminal of the electric wire We.

In the exemplified terminal metal fitting 10, one of the end parts of the electrical connection part 11 arranged to be opposed to each other, that is, one end part 11*c* side becomes a distal end, and the electric wire connection part 12 is arranged on the other one thereof, that is, an end part 11*d* side (FIGS. 6 to 9).

The exemplified terminal metal fitting 10 has a virtual axis P along an axial direction of the terminal of the electric wire We that is physically and electrically connected to the electric wire connection part 12 (FIGS. 8 and 9), and a part 13 to be held (described later), the electrical connection part 11, and the electric wire connection part 12 are arranged in this order from the distal end along the virtual axis P.

Figure 8:
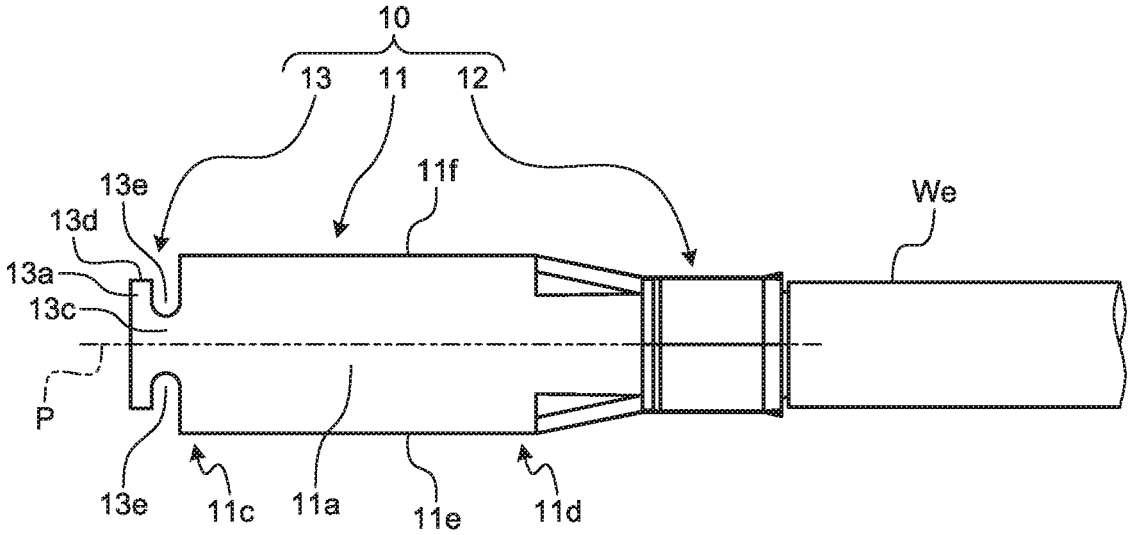
FIG. 8 is a plan view of the terminal metal fitting attached to the electric wire viewed from a first wall surface side.

Specifically, the electrical connection part 11 is extended in a direction along the virtual axis P (hereinafter, simply referred to as an "axial direction"). One end in the axial direction of the electrical connection part 11 is the one end part 11*c*, and the other end thereof in the axial direction is the other end part 11*d* (FIGS. 8 and 9). The electrical connection part 11 includes two end faces (a first end face 11*e*, a second end face 11*f*) that are arranged to be opposed to each other, the first end face 11*e* and the second end face 11*f* being different from the two end parts 11*c* and 11*d* arranged to be opposed to each other (FIG. 8). The first end face 11*e* and the second end face 11*f* are arranged in parallel to be opposed to each other in a direction orthogonal to the axial direction of the terminal metal fitting 10 and orthogonal to a direction orthogonal to the first and the second wall surfaces 11*a* and 11*b*. In the electrical connection part 11, the first end face 11*e* and the second end face 11*f* around the virtual axis P as a center form substantially rectangular flat plates having the same shape.

The connector 1 according to the present embodiment includes the terminal metal fitting 10 for each number of poles, for example. Herein, two terminal metal fittings 10 are arranged (FIG. 5). The connector 1 is illustrated such that a plurality of same terminal metal fittings 10 are included in the housing 20. However, the exemplified terminal metal fitting 10 and a terminal metal fitting having a shape different from that of the exemplified terminal metal fitting 10 may be arranged in a mixed manner.

Subsequently, the following describes the housing 20 according to the present embodiment.

The housing 20 according to the present embodiment includes a housing body 20A that houses the terminal metal fitting 10 (FIGS. 2 to 5, and 10). The housing 20 according to the present embodiment further includes a shield shell 20B that accommodates a part from the housing body 20A to the terminal of the electric wire We and covers the part from the outside (FIGS. 1 to 5). The housing 20 according to the present embodiment further includes a holding member 20C that prevents, on the electric wire We side, the terminal metal fitting 10 from falling out from the housing body 20A (FIGS. 4 and 5).

First, the following describes the housing body 20A.

The housing body 20A is formed with an insulating material such as a synthetic resin. The housing body 20A houses the electrical connection part 11 in an inward housing space 33 (described later), and causes the electric wire connection part 12 to project outward. The housing body 20A according to the present embodiment is divided broadly into a first housing member 30 and a second housing member 40 (FIGS. 2 to 5, and 10).

The first housing member 30 is formed to be a tubular body at least one end of which in a tube axis direction is opened. Thus, the first housing member 30 includes an outer peripheral wall 31 having a tubular shape (FIGS. 3 to 5, and 10). In the exemplified first housing member 30, the outer peripheral wall 31 is formed in an angular tubular shape, and one end in the tube axis direction is opened and the other end is blocked. The counterpart terminal 110 is inserted from an opening 32 (FIGS. 2, 4, and 10) at one end of the first housing member 30 into the inward housing space 33 (FIGS. 2 and 10) along the tube axis direction. Strictly speaking, as described later, the counterpart terminal 110 is inserted into the housing space 33 from the opening 32 via the second housing member 40.

Figure 10:
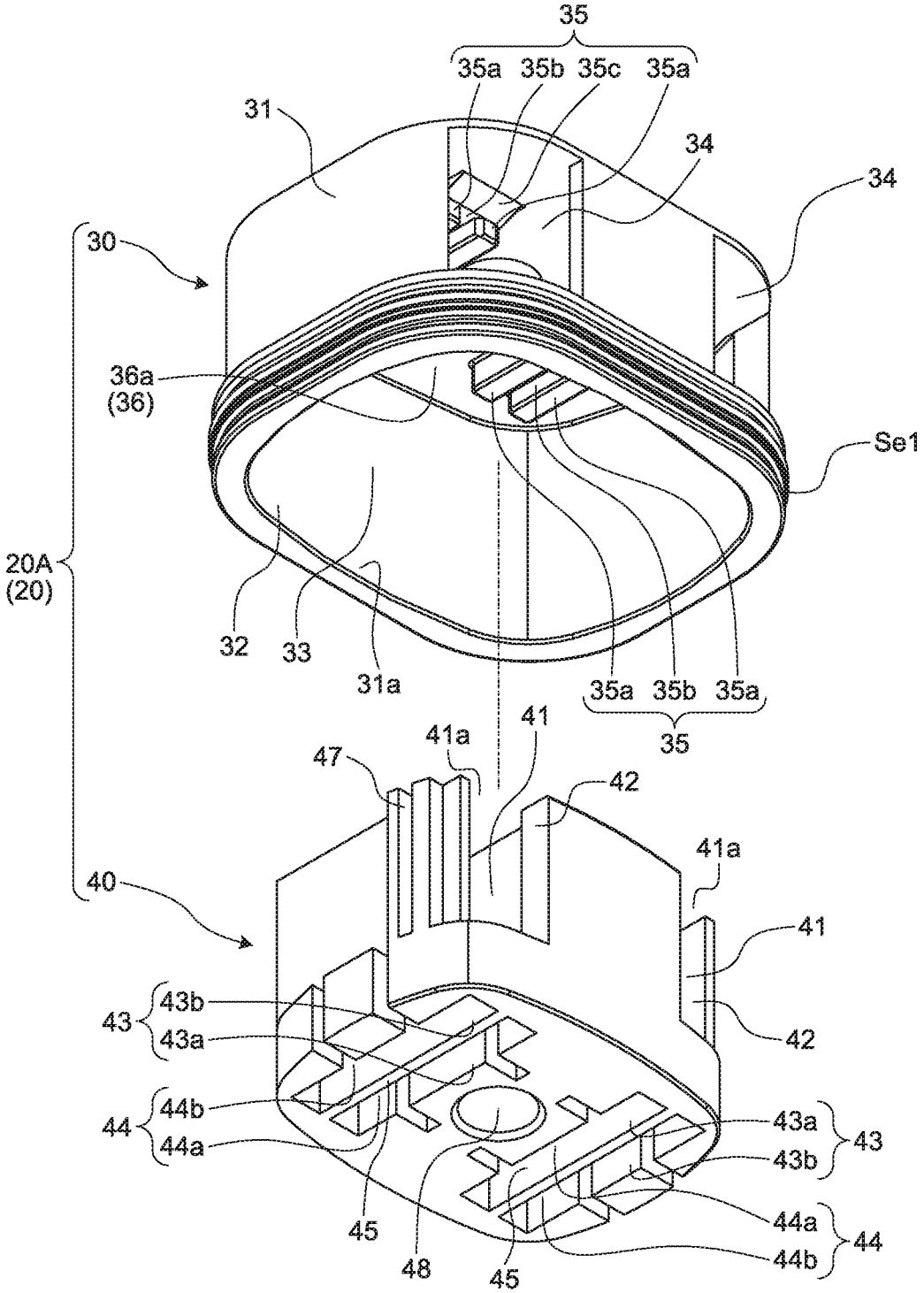
FIG. 10 is an exploded perspective view of a housing body.

An end part on the opening 32 side of the outer peripheral wall 31 is an engagement part (connector engagement part) 31*a* to be engaged with a connector engagement part 153*e* (described later) of the counterpart connector 101 (FIGS. 4 and 10). The connector engagement part 153*e* is inserted into and engaged with the connector engagement part 31*a*. An annular sealing member Se1 is concentrically attached to an outer peripheral surface of the connector engagement part 31*a* (FIGS. 4, 5, and 10).

The outer peripheral wall 31 includes an insertion hole 34 through which the terminal metal fitting 10 is inserted into the housing space 33 from the distal end on the electrical connection part 11 side (FIGS. 5 and 10). The exemplified first housing member 30 houses the electrical connection part 11 in the inward housing space 33, and causes the electric wire connection part 12 to project outward from the insertion hole 34 (FIG. 4).

The insertion hole 34 is arranged for each terminal metal fitting 10. Thus, two insertion holes 34 are formed on the exemplified outer peripheral wall 31 (FIGS. 5 and 10). The insertion holes 34 are formed and arranged so that the respective terminal metal fittings 10 are inserted in a state in which axial directions thereof are aligned. That is, in this case, the axial direction of the terminal metal fitting 10 becomes an inserting direction of the terminal metal fitting 10 into the housing space 33 (hereinafter, referred to as a "terminal inserting direction"). The insertion holes 34 are formed and arranged so that the respective terminal metal fittings 10 are inserted in a state in which the first and the second end faces 11*e* and 11*f* of the electrical connection part 11 face the tube axis direction of the outer peripheral wall 31 (that is, in a state in which the first and the second wall surfaces 11*a* and 11*b* of the electrical connection part 11 is along the tube axis direction of the outer peripheral wall 31).

The exemplified first housing member 30 includes a guiding part 35 that guides insertion of the terminal metal fitting 10 into the housing space 33 via the insertion hole 34

(FIGS. 4 and 10). For example, the insertion hole 34 continues to a wall body 36 on the other end in the tube axis direction of the outer peripheral wall 31. Thus, the guiding part 35 is arranged on a wall surface 36*a* on the housing space 33 side of the wall body 36. The guiding part 35 is arranged for each terminal metal fitting 10. Thus, guiding parts 35 are arranged at two positions on the exemplified wall surface 36*a*.

The exemplified guiding part 35 includes two projecting parts 35*a* that is projected from the wall surface 36*a* in the tube axis direction of the outer peripheral wall 31 and extended in the terminal inserting direction (FIG. 10). The projecting parts 35*a* are arranged to be opposed to each other at intervals. The interval is set to be a size equal to a plate thickness of the electrical connection part 11 in a range of not hindering insertion of the electrical connection part 11 into the housing space 33. Thus, in the guiding part 35, a groove (hereinafter, referred to as a "guide groove") 35*b* along the terminal inserting direction is formed between the projecting parts 35*a* (FIGS. 4 and 10). In the terminal metal fitting 10, the electrical connection part 11 is guided from the one end part 11*c* side along the guide groove 35*b*. By setting the guide groove 35*b* to have a size equal to the plate thickness of the electrical connection part 11 as described above, the guide groove 35*b* can suppress wobble of the electrical connection part 11 between the projecting parts 35*a*. A groove bottom $\mathbf{35}b_1$ of the exemplified guide groove 35*b* is made higher than the wall surface 36*a* toward the opening 32 side (FIG. 4).

The exemplified guiding part 35 further includes a guide wall surface 35*c* that guides, to the guide groove 35*b*, the one end part 11*c* side of the electrical connection part 11 inserted from the insertion hole 34 (FIGS. 4 and 10). The guide wall surface 35*c* is an inclined surface that guides the one end part 11*c* side of the electrical connection part 11 to the groove bottom $\mathbf{35}b_1$ of the guide groove 35*b* from the wall surface 36*a*.

Figure 11:
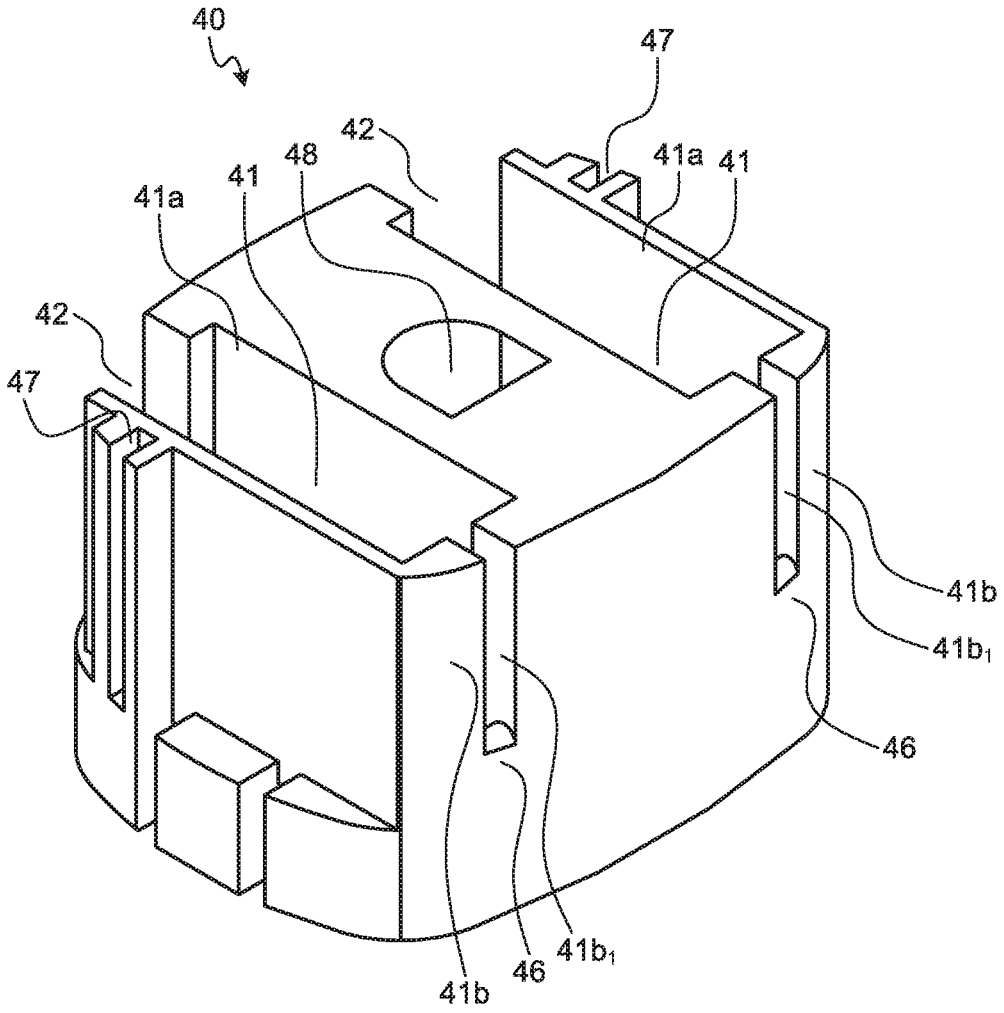
FIG. 11 is a perspective view of a second housing member viewed from a different angle.

The second housing member 40 is formed to be a polyhedron matched with a shape of the housing space 33 of the first housing member 30 (FIGS. 10 and 11). The second housing member 40 is housed in the housing space 33 along the tube axis direction from the opening 32 of the first housing member 30 (FIGS. 2, 4, 5, and 10). The second housing member 40 houses the electrical connection part 11 of the terminal metal fitting 10 therein in a state of being completely housed in the housing space 33 (FIG. 4).

The second housing member 40 includes a terminal housing chamber 41 that houses the electrical connection part 11 in the housing space 33 (FIGS. 4, 5, and 10 to 12). As the second housing member 40 is inserted into the housing space 33, the terminal housing chamber 41 starts to house the electrical connection part 11 housed in the housing space 33 through an opening 41*a* (FIGS. 5, 10, and 11). When the second housing member 40 is completely housed in the housing space 33, the terminal housing chamber 41 completely houses the electrical connection part 11. Thus, the second housing member 40 includes a notch part 42 that causes the terminal housing chamber 41 to communicate with the outside thereof on the outer peripheral surface side (FIGS. 5, 10, and 11). The electric wire connection part 12 is projected to the outside of the second housing member 40 from the notch part 42. The notch part 42 is arranged to be opposed to the insertion hole 34 in a state in which the second housing member 40 is housed in the housing space 33 so that the electric wire connection part 12 is projected outward from the insertion hole 34 of the first housing member 30.

When engagement between the connector 1 and the counterpart connector 101 (hereinafter, referred to as "connector engagement") is completed, the first and the second electrical connection parts 121 and 122 and two contact members 130 (described later) of the counterpart terminal 110 are housed in the terminal housing chamber 41. In the terminal housing chamber 41, the respective contact members 130 are brought into contact with the first wall surface 11*a* and the second wall surface 11*b* of the electrical connection part 11 to be physically and electrically connected with each other. Thus, the second housing member 40 includes a terminal insertion port 43 for inserting the counterpart terminal 110 into the terminal housing chamber 41 (FIGS. 2, 3, 10, and 12). The terminal insertion port 43 is formed to be arranged on the opening 32 side of the first housing member 30 in a state in which the second housing member 40 is housed in the housing space 33, and is arranged to be opposed to the terminal housing chamber 41 in the tube axis direction of the outer peripheral wall 31. Thus, any one of the first end face 11*e* and the second end face 11*f* of the electrical connection part 11 housed in the housing space 33 is arranged to be opposed to the terminal insertion port 43.

The second housing member 40 includes a communication chamber 44 that causes the terminal housing chamber 41 to communicate with the terminal insertion port 43 in the tube axis direction of the outer peripheral wall 31 (FIGS. 2, 3, 10, and 12). Thus, when the electrical connection part 11 is housed in the terminal housing chamber 41, one of the first end face 11*e* and the second end face 11*f* of the electrical connection part 11 is arranged to be opposed to the terminal insertion port 43 via the communication chamber 44.

The second housing member 40 includes a contact prevention part 45 that blocks a finger to prevent a finger of an operator and the like from being brought into contact with the electrical connection part 11 via the terminal insertion port 43 (FIGS. 2 to 4, 10, and 12). The contact prevention part 45 is formed and arranged so that the finger does not reach the electrical connection part 11 via the terminal insertion port 43. For example, the contact prevention part 45 is arranged to cover, from the terminal insertion port 43 side in the tube axis direction of the outer peripheral wall 31, at least part of the end face of the electrical connection part 11 (the first end face 11*e* or the second end face 11*f*) that is arranged to be opposed to the terminal insertion port 43. The contact prevention part 45 is arranged in the communication chamber 44 not to hinder insertion of the counterpart terminal 110 into the terminal housing chamber 41.

The exemplified contact prevention part 45 is formed in a flat plate shape having two flat wall surfaces, and formed in the communication chamber 44 so that the two wall surfaces are along the tube axis direction of the outer peripheral wall 31. Herein, the contact prevention part 45 is formed in a rectangular flat plate shape. The contact prevention part 45 is arranged to divide the communication chamber 44 into two chambers in a direction orthogonal to the first and the second wall surfaces 11*a* and 11*b* of the electrical connection part 11. That is, the communication chamber 44 is partitioned into a first divided communication chamber 44*a* and a second divided communication chamber 44*b* in the orthogonal direction by the contact prevention part 45 (FIGS. 2, 3, 10, and 12). Herein, the terminal insertion port 43 is also partitioned into a first divided insertion port 43*a* and a second divided insertion port 43*b* in the orthogonal direction by the contact prevention part 45 (FIGS. 2, 3, 10, and 12). Thus, the first electrical connection part 121 (described later) of the counterpart terminal 110 is inserted into the terminal housing chamber 41 via the first divided insertion port 43*a* and the first divided communication chamber 44*a*. The second electrical connection part 122 (described later) of the counterpart terminal 110 is inserted into the terminal housing chamber 41 via the second divided insertion port 43*b* and the second divided communication chamber 44*b*.

In this example, a combination of the first electrical connection part 121 and one contact member 130, and a first housing body 151 (described later) are inserted from the first divided insertion port 43*a* into the first divided communication chamber 44*a*, and then inserted into the terminal housing chamber 41. In the terminal housing chamber 41, the one contact member 130 is brought into contact with the first wall surface 11*a* of the electrical connection part 11, and the electrical connection part 11 is electrically connected to the first electrical connection part 121. In this example, a combination of the second electrical connection part 122 and the other contact member 130, and a second housing body 152 (described later) are inserted from the second divided insertion port 43*b* into the second divided communication chamber 44*b*, and then inserted into the terminal housing chamber 41. In the terminal housing chamber 41, the other contact member 130 is brought into contact with the second wall surface 11*b* of the electrical connection part 11, and the electrical connection part 11 is electrically connected to the second electrical connection part 122. Thus, in the second housing member 40, the first divided insertion port 43*a*, the second divided insertion port 43*b*, the first divided communication chamber 44*a*, the second divided communication chamber 44*b*, and the contact prevention part 45 are formed and arranged to enable the insertion described above.

The second housing member 40 includes a terminal holding part 46 that holds the part 13 to be held (FIGS. 3 and 4, and 6 to 9) of the terminal metal fitting 10 so that the electrical connection part 11 does not fall out from the terminal housing chamber 41 (FIGS. 4 and 11). The terminal holding part 46 is formed to hold the part 13 to be held to prevent the electrical connection part 11 from falling out from the terminal housing chamber 41 (FIG. 4). The part 13 to be held and the terminal holding part 46 are formed and arranged to be able to hold at least one of a distal end side and a base side of the terminal metal fitting 10. However, in the exemplified terminal metal fitting 10, the electric wire connection part 12 is projected to the outside of the housing body 20A. Thus, the base side of the terminal metal fitting 10 as an arrangement place of the part 13 to be held indicates the end part 11*d* on the electric wire connection part 12 side of the electrical connection part 11. For example, herein, the part 13 to be held is formed as a part to be inserted at the distal end of the terminal metal fitting 10, and the terminal holding part 46 is formed as an inserting part that is inserted into the housing space 33 of the second housing member 40 and inserted into the part 13 to be held. The part 13 to be held and the terminal holding part 46 are formed to lock movement of the terminal metal fitting 10 in the terminal inserting direction with respect to the housing space 33, and movement of the terminal metal fitting 10 in a direction reverse to the terminal inserting direction.

Specifically, the exemplified part 13 to be held is formed in a T-shape that is projected from the distal end (the one end part 11*c*) of the electrical connection part 11 along the virtual axis P. The part 13 to be held includes a T-shaped first wall surface 13*a* (FIGS. 6, 8, and 9) arranged on the same plane as that of the first wall surface 11*a* of the electrical connection part 11, and a T-shaped second wall surface 13*b* (FIGS. 7 and 9) arranged on the same plane as that of the second wall surface 11*b* of the electrical connection part 11. The part 13 to be held also includes a T-shaped shaft part 13*c* having a center axis arranged on the virtual axis P, and an intersecting part 13*d* orthogonal to the shaft part 13*c* at a distal end of the shaft part 13*c* (FIGS. 6 to 9). The part 13 to be held utilizes, as a part to be inserted, a notch-shaped groove part 13*e* (FIGS. 4, and 6 to 9) that is formed between the part 13 to be held and the one end part 11*c* of the electrical connection part 11. Groove parts 13*e* are formed at two positions across the virtual axis P as a center.

The exemplified part 13 to be held is formed such that both groove parts 13*e* across the virtual axis P as a center have the same shape in a direction orthogonal to the axial direction and orthogonal to a direction orthogonal to the first and the second wall surfaces 13*a* and 13*b*. Accordingly, the part 13 to be held can utilize both groove parts 13*e* as parts to be inserted. For example, in the terminal metal fitting 10, when the first end face 11*e* is arranged to be opposed to the terminal insertion port 43 in the terminal housing chamber 41, one of the two groove parts 13*e* is utilized as the part to be inserted. In the terminal metal fitting 10, when the second end face 11*f* is arranged to be opposed to the terminal insertion port 43 in the terminal housing chamber 41, the other one of the two groove parts 13*e* is utilized as the part to be inserted.

The terminal holding part 46 is inserted into the groove part 13*e* of the part 13 to be held in a state in which the second housing member 40 is housed in the housing space 33. In this example, a notch-shaped groove part 41$b_1$ notched along the tube axis direction of the outer peripheral wall 31 is formed in a wall part 41*b* constituting the terminal housing chamber 41 (FIG. 11). The exemplified terminal holding part 46 utilizes, as the inserting part into the part 13 to be held, a remaining part of the wall part 41*b* the apex of which is a bottom part side of the groove part 41$b_1$. In the exemplified part 13 to be held and terminal holding part 46, the groove parts 13*e* and 41$b_1$ start to be engaged with each other as the second housing member 40 is inserted into the housing space 33. In the part 13 to be held and the terminal holding part 46, the remaining part of the wall part 41*b* is completely inserted into the groove part 13*e* at the same time as the second housing member 40 is completely housed in the housing space 33, and the electrical connection part 11 can be held by the terminal housing chamber 41 in a housed state.

Figure 3:
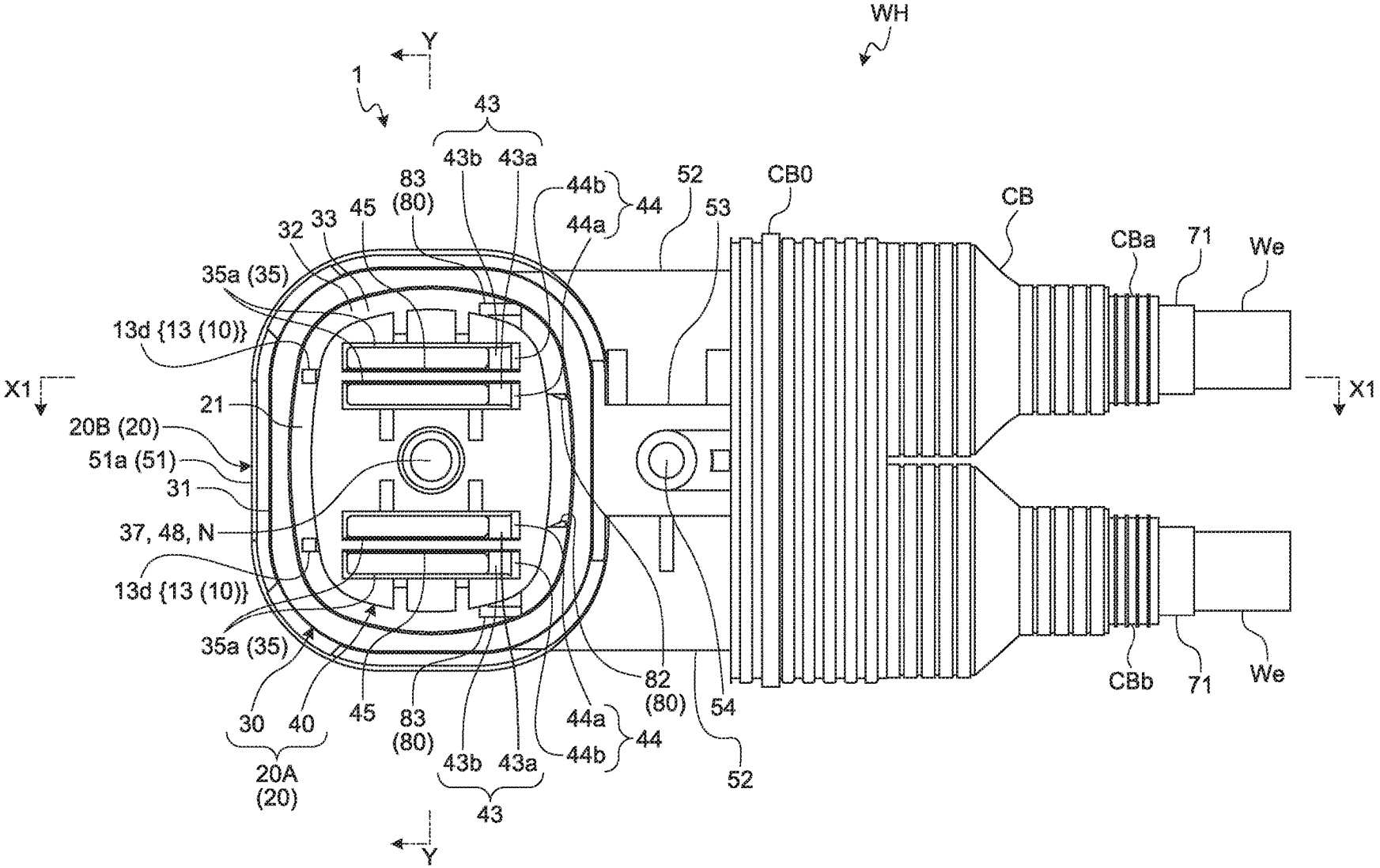
FIG. 3 is a plan view of the connector and the electric wire with a connector according to the embodiment viewed from a terminal insertion port side.

In the part 13 to be held, when the remaining part of the wall part 41*b* is inserted into the groove part 13*e*, the intersecting part 13*d* is arranged on the outside of the outer peripheral surface of the second housing member 40 (FIGS. 3 and 4). Thus, in the housing body 20A, an annular gap 21 is arranged between an inner peripheral surface of the first housing member 30 and an outer peripheral surface of the second housing member 40 (FIGS. 3 and 4). The size of the gap 21 is set such that the intersecting part 13*d* can be arranged and a finger of an operator and the like cannot enter. In the connector 1, a continuity check can be performed by utilizing the intersecting part 13*d*arranged in the gap 21.

In the guiding part 35 described above, wobble of the electrical connection part 11 can be suppressed between the projecting parts 35*a*. In the electrical connection part 11, in a state in which the second housing member 40 is housed in the housing space 33, one of the first end face 11*e* and the second end face 11*f* is arranged to be opposed to the groove bottom 35$b_1$ of the guide groove 35*b*, and the other one thereof is arranged to be opposed to an end face 45*a* (an end face opposite to the terminal insertion port 43 side) of the contact prevention part 45 (FIG. 4). The first housing member 30 and the second housing member 40 may be formed such that, in a state in which mutual housing is completed, the electrical connection part 11 is held between the groove bottom 35$b_1$ and the end face 45*a*. That is, the first housing member 30 and the second housing member 40 may be formed to sandwich and hold the electrical connection part 11 therebetween in a state in which mutual housing is completed. Due to this, the connector 1 can enhance a falling-out prevention effect for the electrical connection part 11 in the terminal housing chamber 41 by the terminal holding part 46, and can suppress wobble of the electrical connection part 11 in the terminal housing chamber 41. Thus, the connector 1 can enhance vibration resistance, and improve engagement operability between itself and the counterpart connector 101. To obtain such an effect, in the exemplified connector 1, the first housing member 30 and the second housing member 40 are co-fastened to the shield shell 20B with axial force in the tube axis direction as described later.

In the second housing member 40, a combination of the terminal housing chamber 41, the notch part 42, the terminal insertion port 43, the communication chamber 44, the contact prevention part 45, and the terminal holding part 46 is arranged for each terminal metal fitting 10. Each combination is arranged so that a plurality of terminal metal fittings 10 are housed such that the axial direction of the terminal metal fitting 10 is aligned with the terminal inserting direction with respect to the housing space 33. In this example, two such combinations are arranged. One of the combinations is formed and arranged such that the electrical connection part 11 of the terminal metal fitting 10 is housed in the terminal housing chamber 41 in a state in which the first end face 11*e* is arranged to be opposed to the terminal insertion port 43 (that is, in a state in which the first and the second wall surfaces 11*a* and lib are along the tube axis direction of the outer peripheral wall 31). The electrical connection part 11 is inserted into the terminal housing chamber 41 from the first end face 11*e* side. The other one of the combinations is formed and arranged such that the electrical connection part 11 of the terminal metal fitting 10 is housed in the terminal housing chamber 41 in a state in which the second end face 11*f* is arranged to be opposed to the terminal insertion port 43 (that is, in a state in which the first and the second wall surfaces 11*a* and 11*b* are along the tube axis direction of the outer peripheral wall 31). The electrical connection part 11 is inserted into the terminal housing chamber 41 from the second end face 11*f* side.

Next, the following describes the shield shell 20B. The shield shell 20B is a first shielding member that prevents entry of external noise at a part from the housing body 20A obtained by assembling the first housing member 30 with the second housing member 40 to the terminal of the electric wire We. The shield shell 20B accommodates the part therein and covers the part from the outside. The shield shell 20B is formed with a conductive material such as metal. The shield shell 20B includes a main shield body 51 that covers the housing body 20A from the outside while exposing the opening 32 side, and a sub-shield body 52 that covers, from the outside, the electric wire connection part 12 projecting to the outside of the housing body 20A from the insertion hole 34 and the terminal of the electric wire We (FIGS. 1 to 5, 13, and 14).

The main shield body 51 includes an outer peripheral wall 51*a* having a tubular shape one end of which is opened and the other end of which is blocked (FIGS. 1 to 5, 13, and 14). The exemplified outer peripheral wall 51*a* is formed in an angular tubular shape corresponding to the external shape of the first housing member 30, that is, the angular tubular shape. In the main shield body 51, the first housing member 30 is inserted into an inward housing space 51*c* (FIG. 14) along the tube axis directions thereof from an opening 51*b* (FIGS. 2, 4, and 14) at one end of the main shield body 51. The sealing member Se1 is brought into intimate contact with an inner peripheral surface of the outer peripheral wall 51*a* in a state in which the first housing member 30 is housed in the housing space 51*c*, and improves a liquid-tight property between the connector engagement part 31*a* and the main shield body 51 (FIG. 4).

Figure 14:
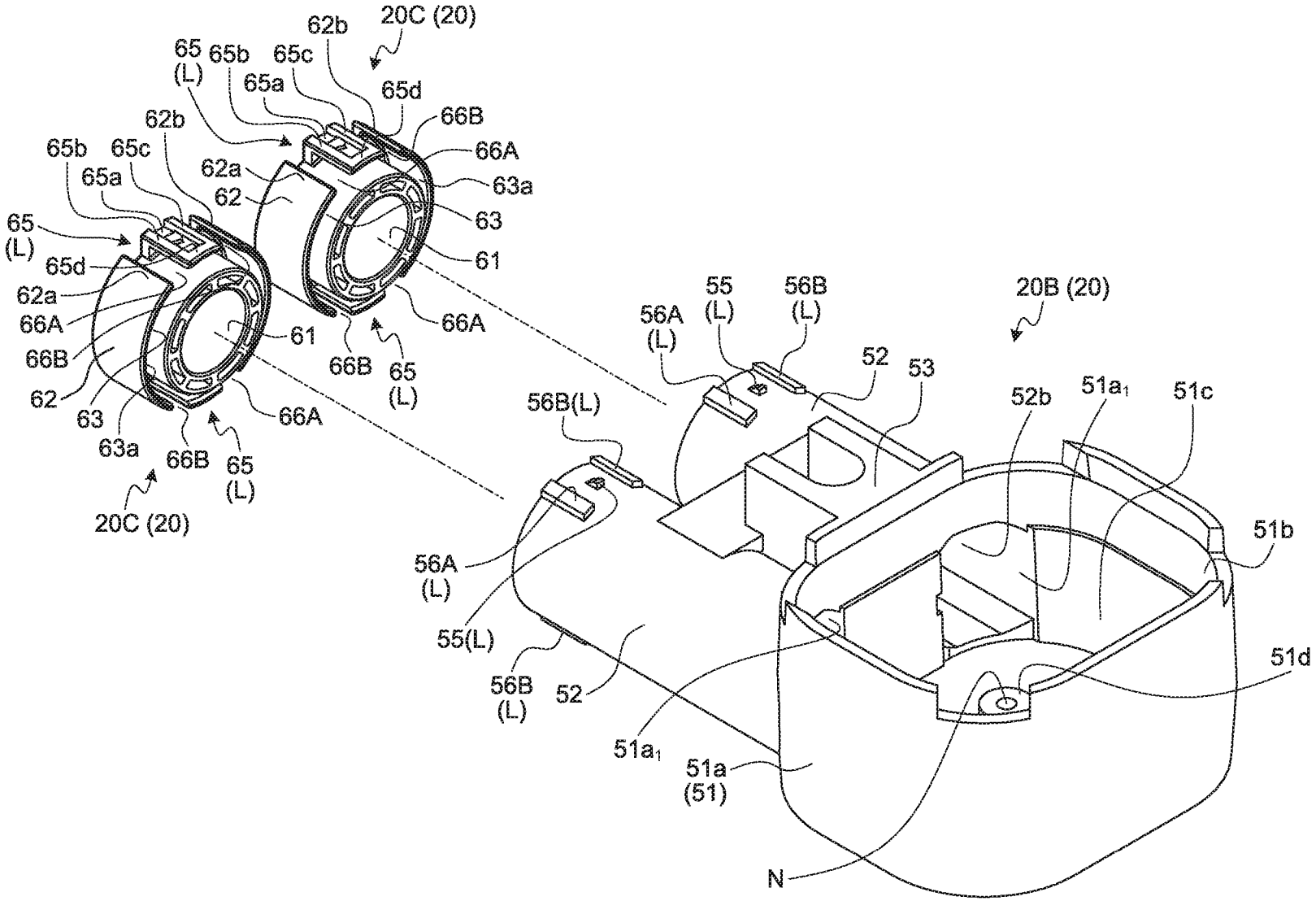
FIG. 14 is an exploded perspective view illustrating the shield shell and the holding member viewed from an opening side.

The outer peripheral wall 51*a* includes a through hole 51$a_1$ that is arranged to be opposed to the insertion hole 34 in a state in which the first housing member 30 is housed in the housing space 51*c* (FIG. 14). The through hole 51$a_1$ is arranged for each terminal metal fitting 10. In this example, two through holes 51$a_1$ are arranged.

The sub-shield body 52 is arranged for each terminal metal fitting 10. Thus, in this case, two sub-shield bodies 52 are arranged. The sub-shield body 52 is formed in a tubular shape both ends of which are opened. The exemplified sub-shield body 52 is formed in a cylindrical shape. In the shield shell 20B, the sub-shield body 52 is projected toward the outside of the main shield body 51 from a peripheral part of the through hole 51$a_1$ of the main shield body 51. The exemplified sub-shield body 52 is projected so that the tube axis direction is along the terminal inserting direction. In the sub-shield body 52, the terminal metal fitting 10 is inserted into an inward housing space 52*b* from an opening 52*a* on a free end side (FIG. 5). The terminal metal fitting 10 is inserted into the housing space 33 from a distal end via the through hole 51$a_1$ of the main shield body 51 and the insertion hole 34 of the first housing member 30.

The shield shell 20B includes a coupling body 53 that couples the two sub-shield bodies 52 arranged in parallel (FIGS. 2 to 5, and 13). The exemplified coupling body 53 is interposed between the two sub-shield bodies 52. The coupling body 53 includes a through hole 54 for fixing the connector 1 to the counterpart connector 101 (FIG. 3). Details about the through hole 54 will be described later.

An annular sealing member Se2 is concentrically attached to the terminal of the electric wire We (FIGS. 4 and 5). The sealing member Se2 is brought into intimate contact with an inner peripheral surface of the sub-shield body 52 in a state in which the electrical connection part 11 is housed in the housing space 33, and improves a liquid-tight property between the sub-shield body 52 and the electric wire We (FIG. 4).

The holding member 20C is a tubular member that includes a tubular outer peripheral wall (an outer peripheral wall 62 described later) to which an end part on the opening 52*a* side of the sub-shield body 52 is fit, and is formed to enable the electric wire We routed in the housing space 52*b* of the sub-shield body 52 to be pulled out to the outside. The holding member 20C is formed with a conductive material such as metal. The holding member 20C is arranged for each terminal metal fitting 10. In this example, two holding members 20C are arranged.

Figure 13:
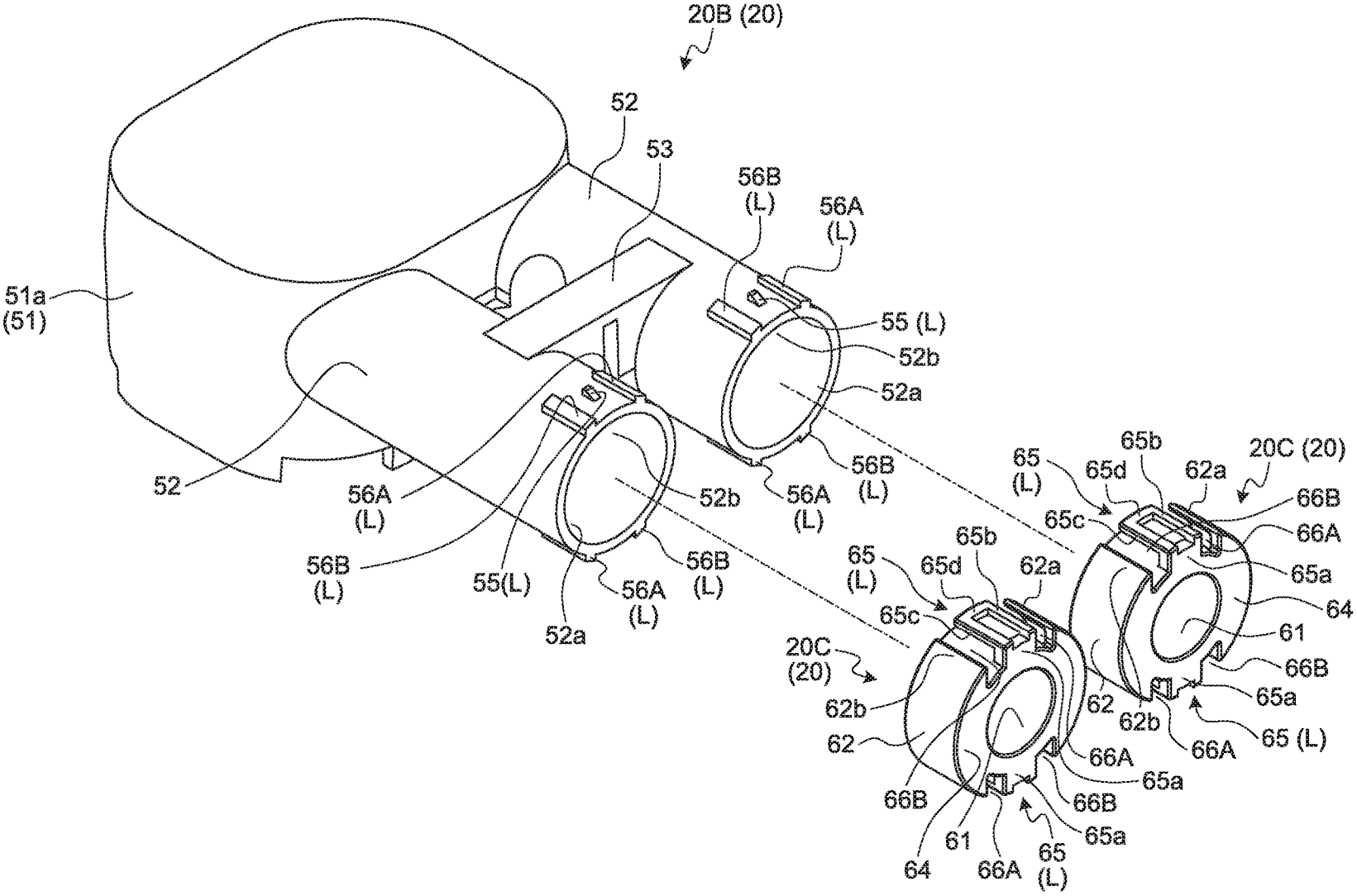
FIG. 13 is an exploded perspective view illustrating a shield shell and a holding member.

The exemplified holding member 20C includes an inner peripheral wall 61 having a cylindrical shape and an outer peripheral wall 62 having a cylindrical shape that are concentrically arranged at intervals in a radial direction (FIGS. 13 and 14). Both ends in the tube axis direction of each of the inner peripheral wall 61 and the outer peripheral wall 62 are opened. Thus, in the holding member 20C, a gap 63 having a cylindrical shape is formed between the inner peripheral wall 61 and the outer peripheral wall 62 (FIG. 14). In the exemplified holding member 20C, an annular opening at an end in the tube axis direction of the cylindrical gap 63 is blocked with a wall having an annular shape (hereinafter, referred to as an "annular wall") 64 (FIG. 13). In the holding member 20C, an end part on the opening 52*a* side of the sub-shield body 52 is inserted into and engaged with the cylindrical gap 63 from an opening 63*a* (FIG. 14) on the other end in the tube axis direction. Thus, in the holding member 20C, the inner peripheral wall 61 is inserted into the housing space 52*b* of the sub-shield body 52, and the outer peripheral wall 62 covers an outer peripheral surface of the sub-shield body 52. In the holding member 20C, the electric wire We routed in the housing space 52*b* of the sub-shield body 52 is guided to an inward space of the inner peripheral wall 61, and pulled out to the outside from an opening at an end of the inner peripheral wall 61.

The sub-shield body 52 and the holding member 20C keeps a mutual engaging state using a lock mechanism L (FIGS. 13 and 14). In this example, lock mechanisms L are arranged at two positions. The lock mechanism L includes a first engaging body 55 arranged in the sub-shield body 52 and a second engaging body 65 arranged in the holding member 20C.

The first engaging body 55 is projected outward in the radial direction from an outer peripheral surface at the end part on the opening 52*a* side of the sub-shield body 52. The exemplified first engaging body 55 is formed in a pawl shape that can catch the second engaging body 65.

On the other hand, the second engaging body 65 is arranged at a place obtained by removing part of the outer peripheral wall 62 of the holding member 20C in a circumferential direction. The exemplified second engaging body 65 includes a base 65*a* that is projected outward in the radial direction from an outer peripheral surface of the inner peripheral wall 61 on the same plane as that of the annular wall 64 (FIGS. 13 and 14). The exemplified second engaging body 65 also includes first and second flexible shaft parts 65*b* and 65*c* having flexibility at both ends in a circumferential direction of the base 65*a* (FIGS. 13 and 14). The first and the second flexible shaft parts 65*b* and 65*c* are projected from both ends in the circumferential direction of the base 65*a* in the tube axis direction of the holding member 20C toward the opening 63*a*. The first and the second flexible shaft parts 65*b* and 65*c* are arranged at substantially the same position as that of the outer peripheral wall 62 in the radial direction of the holding member 20C. The exemplified second engaging body 65 also includes an engaging part 65*d* that connects end parts on a projecting side of the first and the second flexible shaft parts 65*b* and 65*c* (FIGS. 13 and 14). In the second engaging body 65, by causing the first and the second flexible shaft parts 65*b* and 65*c* to be bent, the engaging part 65*d* can be moved in the radial direction with respect to the inner peripheral wall 61.

In the lock mechanism L, when the holding member 20C is started to be inserted into and engaged with the end part on the opening 52*a* side of the sub-shield body 52, the engaging part 65*d* runs onto the first engaging body 55 while bending the second engaging body 65. In the lock mechanism L, when the sub-shield body 52 is completely engaged with the holding member 20C, the engaging part 65*d* of the second engaging body 65 gets over the first engaging body 55, and bending of the second engaging body 65 is released. Due to this, in the lock mechanism L, the first engaging body 55 and the engaging part 65*d* of the second engaging body 65 are caused to be in a lockable state in the tube axis direction of the outer peripheral wall 62 so that the holding member 20C does not fall out from the sub-shield body 52.

The sub-shield body 52 includes a locking body on an outer peripheral surface of the end part on the opening 52*a* side. The locking body is a projecting body that is projected from the outer peripheral surface of the end part on the opening 52*a* side of the sub-shield body 52. A plurality of locking bodies are preferably arranged on the outer peripheral surface. The holding member 20C includes a gap in the outer peripheral wall 62 into which the locking body is inserted. In the lock mechanism L, the holding member 20C is engaged with the end part on the opening 52*a* side of the sub-shield body 52, and the locking body is inserted into the gap in a state in which the first engaging body 55 is completely engaged with the second engaging body 65. In this case, two locking bodies (first and second locking bodies 56A and 56B) are arranged on the sub-shield body 52, and two gaps (first and second gaps 66A and 66B) are arranged in the holding member 20C (FIGS. 13 and 14). In the lock mechanism L, the holding member 20C is engaged with the end part on the opening 52*a* side of the sub-shield body 52, and the first locking body 56A is inserted into the first gap 66A and the second locking body 56B is inserted into the second gap 66B in a state in which the first engaging body 55 is completely engaged with the second engaging body 65.

Specifically, the exemplified first and the second locking bodies 56A and 56B are projected outward in the radial direction at the end part on the opening 52*a* side of the sub-shield body 52 from the outer peripheral surface thereof, and extended in the tube axis direction of the sub-shield body 52. In this case, the first and the second locking bodies 56A and 56B are formed in a rectangular solid shape. Additionally, the exemplified first and second locking bodies 56A and 56B are formed on the outer peripheral surface of the end part on the opening 52*a* side of the sub-shield body 52 such that the first engaging body 55 is interposed therebetween in the circumferential direction of the sub-shield body 52. On the other hand, by arranging the first and the second gaps 66A and 66B in the outer peripheral wall 62, one end part 62*a* constituting one wall surface of the first gap 66A and the other end part 62*b* constituting one wall surface of the second gap 66B are formed (FIGS. 13 and 14). The exemplified first gap 66A is arranged between the one end part 62*a* and the first flexible shaft part 65*b* in the circumferential direction of the outer peripheral wall 62 (FIGS. 13 and 14). The exemplified second gap 66B is arranged between the other end part 62*b* and the second flexible shaft part 65*c* in the circumferential direction of the outer peripheral wall 62 (FIGS. 13 and 14).

The first locking body 56A and the first gap 66A are formed and arranged such that, when the first locking body 56A is inserted into the first gap 66A, between the one end part 62*a* of the outer peripheral wall 62 and the first flexible shaft part 65*b*, one end and the other end in the circumferential direction of the first locking body 56A are arranged to be opposed to the one end part 62*a* and the first flexible shaft part 65*b* in the circumferential direction. The first locking body 56A and the first gap 66A are formed and arranged to be able to suppress relative rotation in the circumferential direction of the sub-shield body 52 and the holding member 20C. For example, the first locking body 56A and the first gap 66A are formed and arranged so that a gap in the circumferential direction between one end in the circumferential direction of the first locking body 56A and the one end part 62*a* of the outer peripheral wall 62, and a gap in the circumferential direction between the other end in the circumferential direction of the first locking body 56A and the first flexible shaft part 65*b* are minimized in a range in which the first locking body 56A can be inserted into the first gap 66A. Due to this, when the sub-shield body 52 and the holding member 20C are about to relatively rotate in the circumferential direction, the first locking body 56A is locked to the one end part 62*a* of the outer peripheral wall 62 or the first flexible shaft part 65*b* in the circumferential direction. Accordingly, the first locking body 56A and the first gap 66A can suppress relative rotation in the circumferential direction of the sub-shield body 52 and the holding member 20C.

Similarly, the second locking body 56B and the second gap 66B are formed and arranged such that, when the second locking body 56B is inserted into the second gap 66B, between the other end part 62*b* of the outer peripheral wall 62 and the second flexible shaft part 65*c*, one end and the other end in the circumferential direction of the second locking body 56B are arranged to be opposed to the other end part 62*b* and the second flexible shaft part 65*c* in the circumferential direction. The second locking body 56B and the second gap 66B are formed and arranged to be able to suppress relative rotation in the circumferential direction of the sub-shield body 52 and the holding member 20C. For example, the second locking body 56B and the second gap 66B are formed and arranged so that a gap in the circumferential direction between one end in the circumferential direction of the second locking body 56B and the other end part 62*b* of the outer peripheral wall 62, and a gap in the circumferential direction between the other end in the circumferential direction of the second locking body 56B and the second flexible shaft part 65*c* are minimized in a range in which the second locking body 56B can be inserted into the second gap 66B. Due to this, when the sub-shield body 52 and the holding member 20C are about to relatively rotate in the circumferential direction, the second locking body 56B is locked to the other end part 62*b* of the outer peripheral wall 62 or the second flexible shaft part 65*c* in the circumferential direction. Accordingly, the second locking body 56B and the second gap 66B can suppress relative rotation in the circumferential direction of the sub-shield body 52 and the holding member 20C.

The connector 1 includes a second shielding member 71 to be electrically connected to the shield shell 20B in addition to the shield shell 20B as the first shielding member (FIGS. 1 to 5, and 15). The second shielding member 71 covers, from the outside, the end part on the opening 52*a* side of the sub-shield body 52 and the electric wire We pulled out from the opening 52*a* to prevent external noise from entering the electric wire We. The second shielding member 71 is formed in a tubular shape, and arranged for each terminal metal fitting 10. In this case, two second shielding members 71 are arranged. In the connector 1, the electric wire We is pulled out to the outside from the holding member 20C attached to the opening 52*a* of the sub-shield body 52. Thus, the exemplified second shielding member 71 is formed to cover, from the outside, the end part on the opening 52*a* side of the sub-shield body 52, the holding member 20C, and the electric wire We pulled out from the holding member 20C. Due to this, the second shielding member 71 can prevent external noise from entering the electric wire We pulled out from the holding member 20C. Specifically, the exemplified second shielding member 71 is arranged as a braid in which conductive elemental wires are weaved in a tubular shape and a mesh shape. Thus, the exemplified second shielding member 71 has elasticity, and can follow movement such as bending of the inward electric wire We. In the drawing, for convenience of illustration, a specific shape (a mesh and the like) of the second shielding member 71 is not illustrated.

Figure 15:
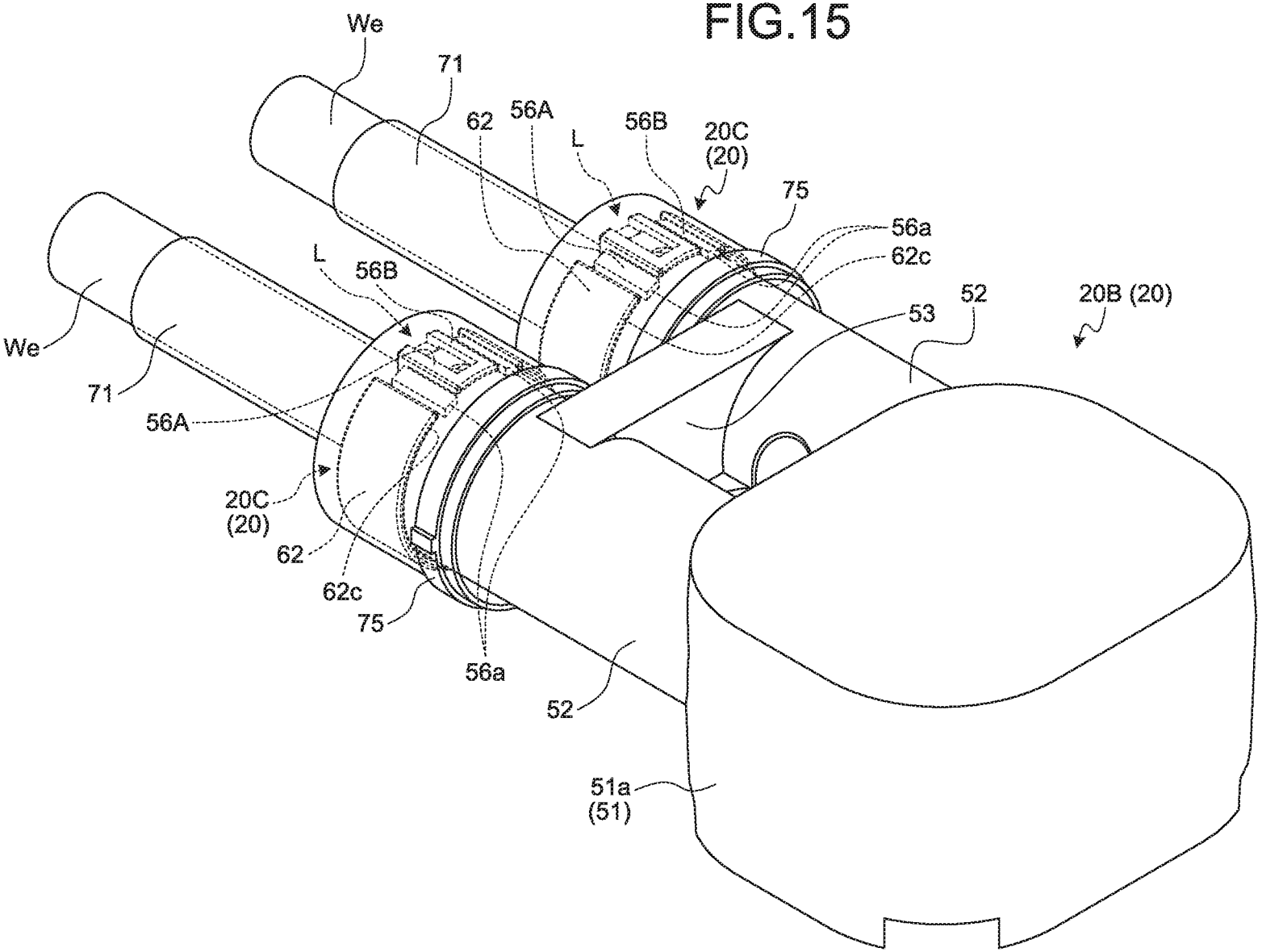
FIG. 15 is a perspective view for explaining a fixed state of a sub-shield body and a second shielding member.

The second shielding member 71 is fixed to the sub-shield body 52 using a binding member (binding band 75) made of a conductive material such as metal (FIGS. 4, 5, and 15). As the binding band 75, used is a binding band known in the art. For example, the binding band 75 is wound around the second shielding member 71 and the end part on the opening 52*a* side of the sub-shield body 52 over the second shielding member 71. The binding band 75 is caused to have an annular shape when being fastened, and fixes the second shielding member 71 to the end part on the opening 52*a* side of the sub-shield body 52.

The binding band 75 is wound at a position opposed to the end face 62*c* on the opening 63*a* side of the outer peripheral wall 62 in the holding member 20C and end faces 56*a* on the main shield body 51 side of the first and the second locking bodies 56A and 56B in the tube axis direction of the sub-shield body 52 (FIG. 15). Accordingly, the binding band 75 having a ring shape (in this case, an annular shape) after winding is arranged to be opposed to the end face 62*c* of the outer peripheral wall 62 and the end faces 56*a* of the first and the second locking bodies 56A and 56B in the tube axis direction. In this example, the end faces 56*a* of the first and the second locking bodies 56A and 56B are projected from the end face 62*c* of the outer peripheral wall 62 in the tube axis direction. Due to this, the end faces 56*a* of the first and the second locking bodies 56A and 56B can be utilized as locking parts that can lock the fastened binding band 75 in the tube axis direction. For example, in the connector 1, when pulling force is generated in the second shielding member 71 in a direction of being pulled out from the sub-shield body 52, even when the binding band 75 moves relatively to the sub-shield body 52 in the tube axis direction together with the second shielding member 71, the binding band 75 is locked by the end faces 56*a* of the first and the second locking bodies 56A and 56B. Thus, in the connector 1, the second shielding member 71 can be held in a state of being fastened to the sub-shield body 52. Thus, the connector 1 can keep a physically and electrically connected state between the sub-shield body 52 and the second shielding member 71, so that shield performance can be prevented from being deteriorated. In this way, in the connector 1, the first and the second locking bodies 56A and 56B have a function of holding the second shielding member 71 onto the sub-shield body 52, and has a function of preventing the holding member 20C from rotating relatively to the sub-shield body 52 described above. Thus, as compared with a connector having the respective functions as different parts, physical constitution of the connector 1 can be prevented from getting large.

Additionally, in the connector 1, by arranging the sub-shield body 52 of the shield shell 20B for each terminal metal fitting 10 and connecting the second shielding member 71 to each sub-shield body 52, each electric wire We is individually covered with the second shielding member 71. Thus, in the connector 1, as compared with a connector in which electric wires We tied up in a bundle are covered with one braid, each electric wire We can be pulled out from the sub-shield body 52 while keeping elasticity thereof, so that a degree of freedom of a routing path of each electric wire We can be improved. In the connector 1, the electric wires We are not required to be tied up in a bundle, so that thermal interference between the electric wires We can be prevented. Thus, in the connector 1, a diameter of each electric wire We can be prevented from being increased, so that a degree of freedom of the routing path of each electric wire We can be further improved.

As described above, in the connector 1, the electric wire connection part 12 of the terminal metal fitting 10 is projected from the insulative housing body 20A, and the projecting electric wire connection part 12 is covered with the conductive sub-shield body 52. Thus, in the connector 1, an insulator is interposed between the conductive electric wire connection part 12 and the sub-shield body 52 to increase an insulation distance (space distance) therebetween. The connector 1 includes an insulative tubular member (hereinafter, referred to as an "insulating cylinder") 80 that covers the electric wire connection part 12 and the terminal of the electric wire We from the outside (FIGS. 3 to 5, 16, and 17).

The insulating cylinder 80 is formed with an insulating material such as a synthetic resin. The exemplified insulating cylinder 80 includes a tubular body 81 having an angular tubular shape that houses the electric wire connection part 12 and the terminal of the electric wire We therein (FIGS. 4, 5, 16, and 17). One end side in the tube axis direction of the tubular body 81 is inserted into the housing space 33 of the first housing member 30 in a state in which the electric wire connection part 12 is housed in the tubular body 81. Thus, the terminal metal fitting 10 is inserted into the housing space 33 from the distal end on the electrical connection part 11 side via the insertion hole 34 together with one end part in the tube axis direction of the insulating cylinder 80. Thus, in the connector 1, it is preferable that the insertion hole 34 of the first housing member 30 is formed in a substantially rectangular shape, and the tubular body 81 is formed to be able to be fitted into the insertion hole 34. In the housing body 20A, the second housing member 40 is inserted into the housing space 33 in a state in which one end part of the insulating cylinder 80 and the electrical connection part 11 are housed in the housing space 33.

Figure 16:
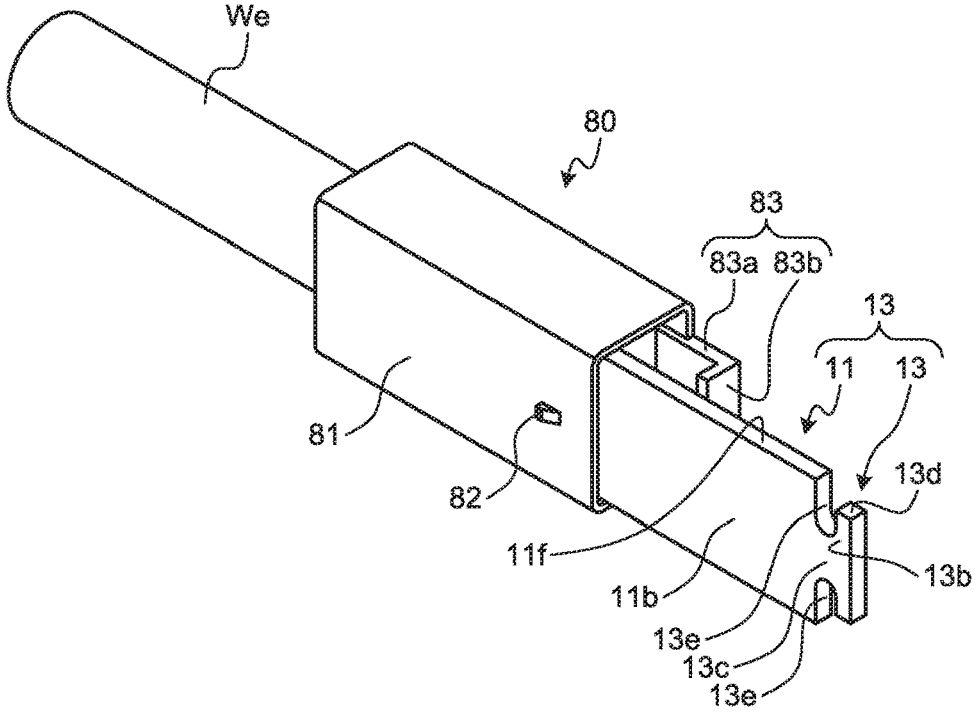
FIG. 16 is a perspective view illustrating an insulating cylinder together with the terminal metal fitting and the electric wire.
Figure 17:
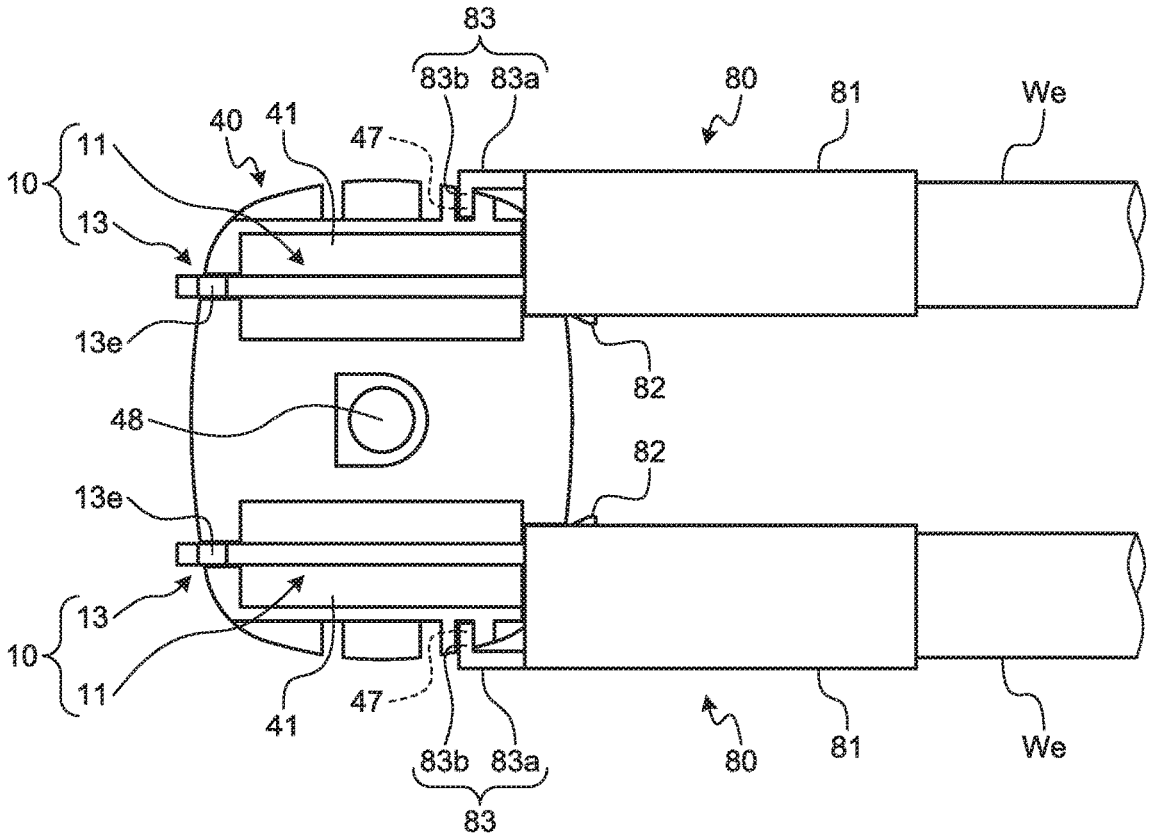
FIG. 17 is a plan view for explaining a locked state of the insulating cylinder and the second housing member.

The exemplified insulating cylinder 80 includes a locking pawl 82 at one end part in the tube axis direction thereof (FIGS. 3, 5, 16, and 17). In this example, the locking pawl 82 is arranged at at least one position on one end side in the tube axis direction of the tubular body 81. The locking pawl 82 is formed as a projecting body at an outer peripheral wall on one end side of the tubular body 81, and housed in the housing space 33. The locking pawl 82 can be locked to a peripheral part of the insertion hole 34 on the outer peripheral wall 31 of the first housing member 30 in the tube axis direction of the tubular body 81 the one end of which is housed in the housing space 33 (FIGS. 3 and 17). The locking pawl 82 can cause the insulating cylinder 80 to be temporarily held by the first housing member 30 until the second housing member 40 is housed in the housing space 33.

Additionally, the connector 1 is configured such that movement in the tube axis direction of the insulating cylinder 80 with respect to the housing body 20A is locked by a part 83 to be locked (FIGS. 3, 5, 16, and 17) arranged in the insulating cylinder 80 and a locking part 47 (FIGS. 10, 11, and 17) arranged in the second housing member 40. The part 83 to be locked and the locking part 47 may have any shape so long as such locking can be implemented. For example, one of the part 83 to be locked and the locking part 47 is formed in a projection shape, and the other one thereof is formed in a groove shape into which a counterpart is inserted. The exemplified insulating cylinder 80 includes the part 83 to be locked at one end part in the tube axis direction thereof. In this example, the part 83 to be locked is arranged on one end side in the tube axis direction of the tubular body 81. The part 83 to be locked is arranged as a piece body projected in the tube axis direction from one end of the tubular body 81. The exemplified part 83 to be locked is formed in an L-shape including a first piece part 83*a* projected in the tube axis direction from one end of the tubular body 81, and a second piece part 83*b* arranged to be orthogonal to the first piece part 83*a* (FIGS. 16 and 17). One end part of the insulating cylinder 80 is inserted into the housing space 33 from the insertion hole 34 so that a direction orthogonal to the L-shaped cross section of the part 83 to be locked faces the tube axis direction of the first housing member 30. The groove-shaped locking part 47 that houses the second piece part 83*b* in the housing space 33 is arranged on the second housing member 40. The locking part 47 is a groove for each insulating cylinder 80 extended along the tube axis direction of the first housing member 30, and causes the second piece part 83*b* to be inserted into the housing space 33 along the tube axis direction of the first housing member 30 when the second housing member 40 is inserted into the housing space 33. The second piece part 83*b* can be locked by two side walls (walls arranged to be opposed to each other along the tube axis direction of the tubular body 81) of the locking part 47. Thus, the connector 1 can prevent misalignment along the tube axis direction of the insulating cylinder 80 with respect to the housing body 20A or the shield shell 20B.

Figure 2:
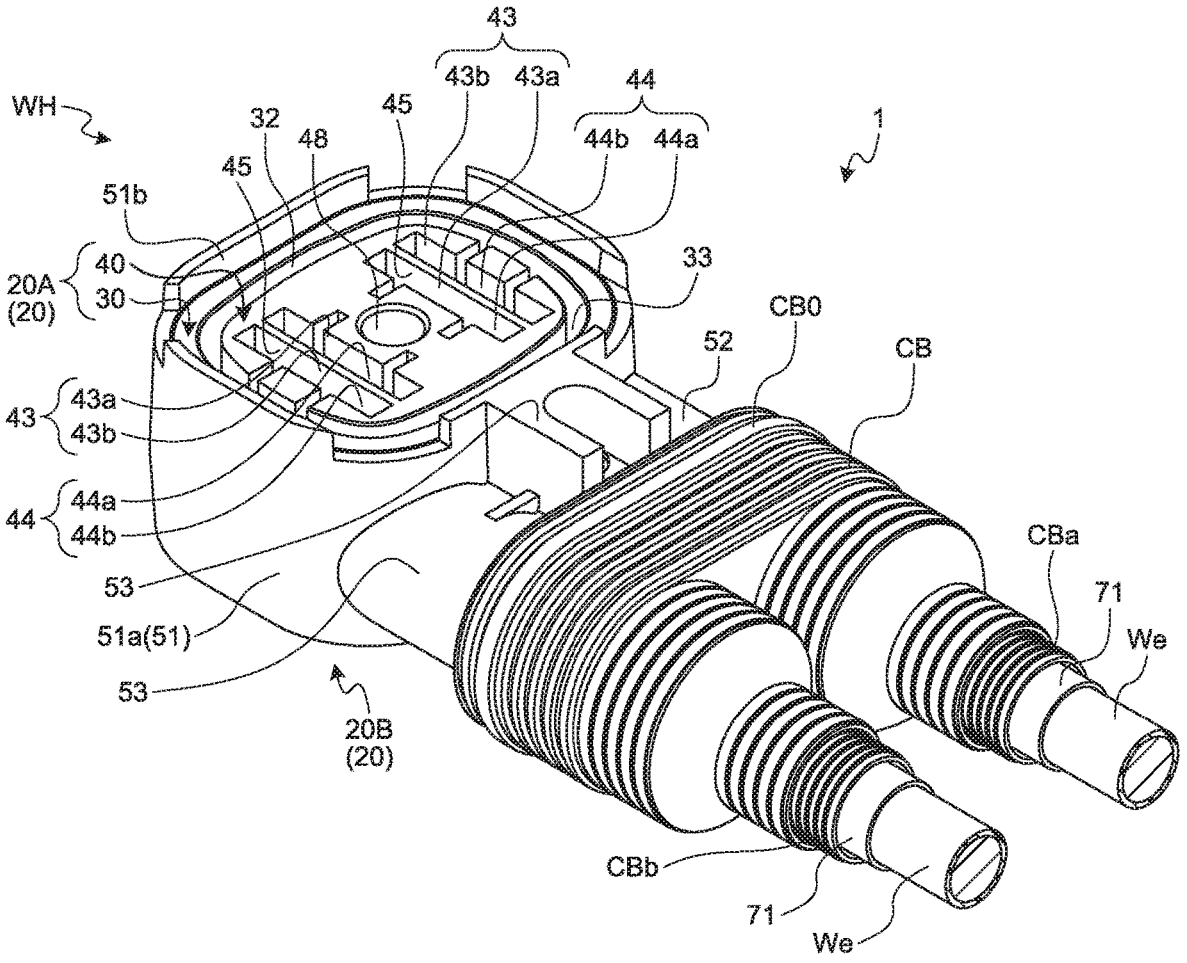
FIG. 2 is a perspective view of the connector and the electric wire with a connector according to the embodiment viewed from a different angle.

In the connector 1, the second shielding member 71 is covered with an exterior member CB from the outside (FIGS. 1 to 5). The exterior member CB is, for example, a corrugated tube or a boot, and is formed with an insulating material such as a synthetic resin. The exemplified exterior member CB is formed to be bendable to improve a degree of freedom of the routing path of the electric wire We. For example, the exterior member CB includes bendable tubular parts CBa and CBb arranged thereon for each electric wire We pulled out from the holding member 20C (FIGS. 1 to 3). The exterior member CB is fixed to the shield shell 20B with a binding band CB0, for example.

Figure 12:
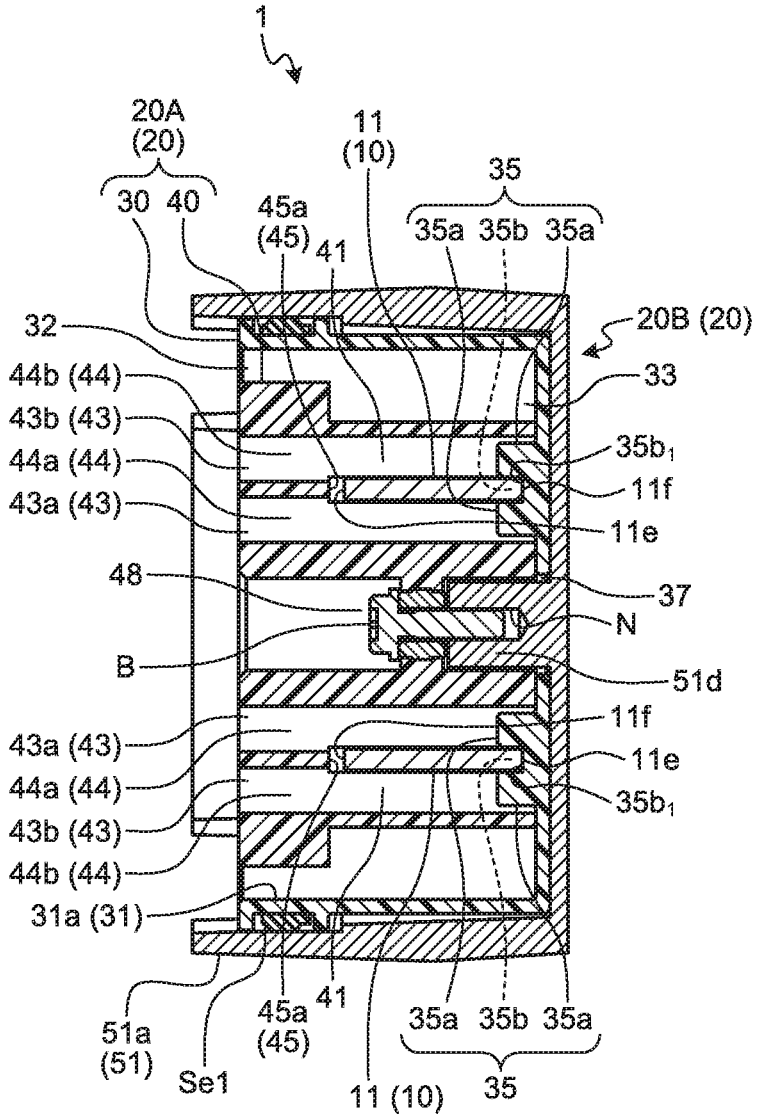
FIG. 12 is a cross-sectional view along the line Y-Y in FIG. 3.

In the connector 1, the first housing member 30 is housed in the housing space 51*c* of the main shield body 51, and the terminal metal fitting 10 that is attached to the terminal of the electric wire We and inserted into the insulating cylinder 80 is housed in the housing space 33 of the first housing member 30 from the distal end. In the connector 1, the second housing member 40 is inserted into the housing space 33 in the above state. To keep a fixed state of these components, in the connector 1, the first housing member 30, the second housing member 40, and the shield shell 20B are screwed to be fixed. For example, a female screw part N the axis of which is the tube axis direction thereof is formed on the exemplified main shield body 51 (FIGS. 12 and 14). The first housing member 30, the second housing member 40, and the shield shell 20B are fixed by screwing a male screw member B (FIG. 5) into the female screw part N. The first housing member 30 has a through hole 37 into which a cylindrical boss part 51*d* (FIGS. 12 and 14) including the female screw part N is inserted (FIGS. 3, 5, and 12). The second housing member 40 has a through hole 48 into which the male screw member B is inserted (FIGS. 3, 5, 11, and 12). Axes of the through holes 37 and 48 are along the tube axis direction of the outer peripheral wall 31. An axis of the boss part 51*d* is along the tube axis direction of the outer peripheral wall 51*a*. Thus, the first housing member 30, the second housing member 40, and the shield shell 20B are co-fastened to each other with axial force in the tube axis direction.

As described above, the connector 1 described above is inserted into and engaged with the counterpart connector 101 to be electrically connected thereto. The following describes the counterpart connector 101.

Figure 18:
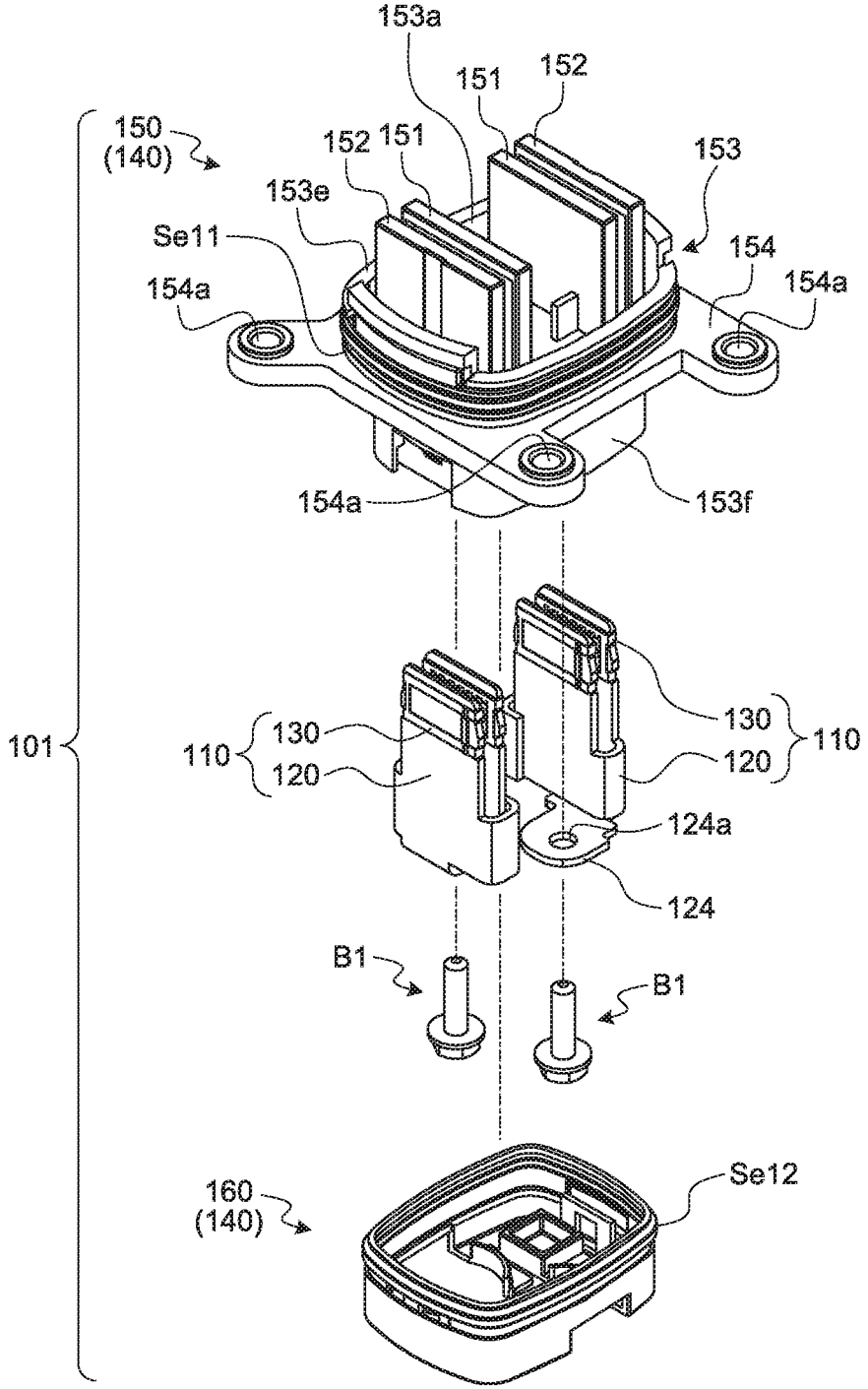
FIG. 18 is an exploded perspective view of a counterpart connector.
Figure 19:
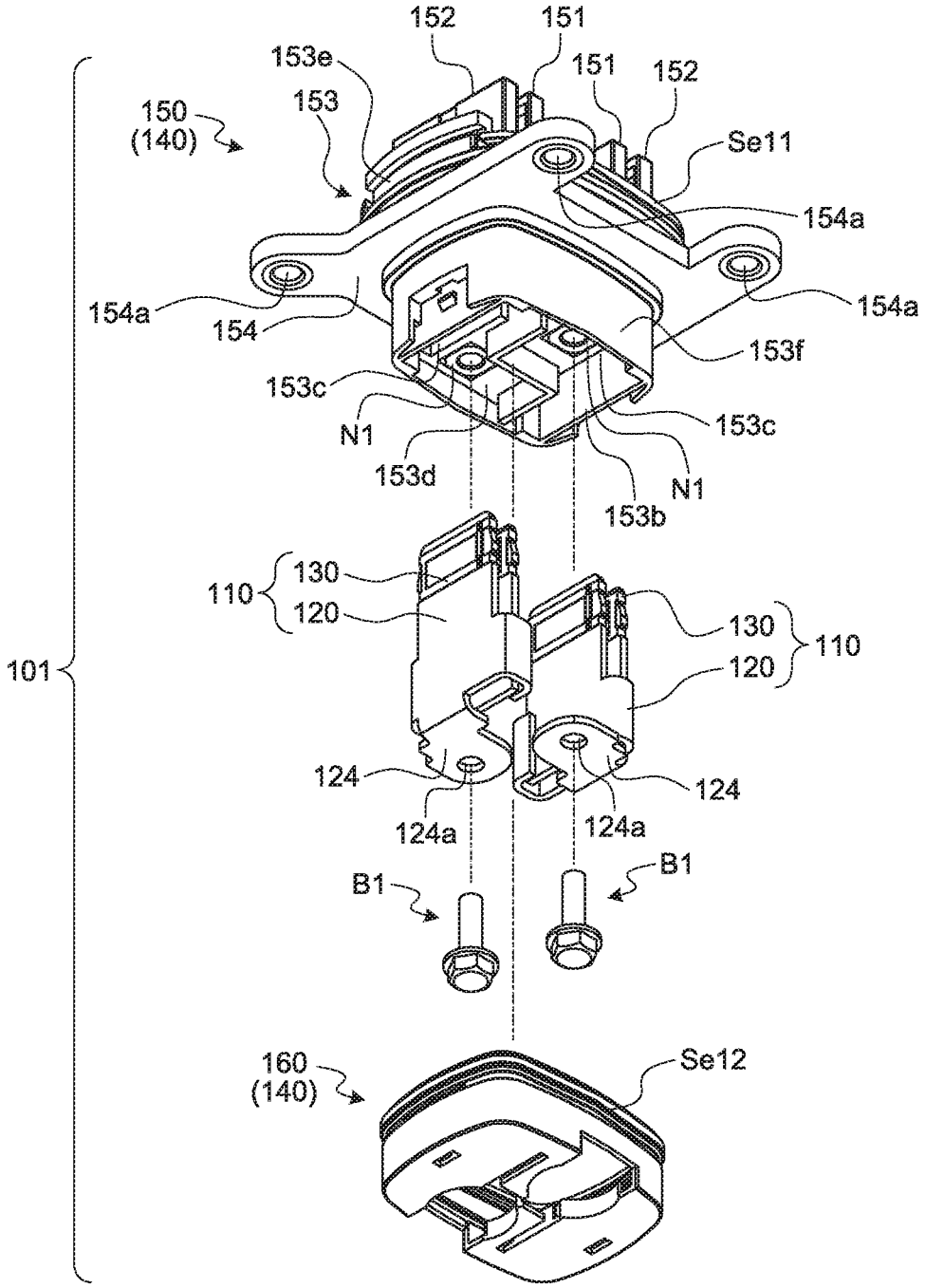
FIG. 19 is an exploded perspective view of the counterpart connector viewed from a different angle.

The counterpart connector 101 includes a counterpart terminal 110 to be electrically connected to the terminal metal fitting 10 (FIGS. 18 and 19). The counterpart terminal 110 is arranged for each terminal metal fitting 10. The exemplified counterpart connector 101 includes two counterpart terminals 110.

The counterpart terminal 110 may utilize itself as a contact part. In this case, a terminal metal fitting (hereinafter, referred to as a "counterpart terminal metal fitting") 120 itself is the counterpart terminal 110. On the other hand, the counterpart terminal 110 may be formed by attaching the contact member 130 to the counterpart terminal metal fitting 120.

The counterpart terminal metal fitting 120 is formed in a female shape with a conductive material such as metal (copper, copper alloy, aluminum, aluminum alloy, and the like). In this example, a conductive metal plate is used as a base material, and the counterpart terminal metal fitting 120 having a female shape is formed by press working such as cutting and bending.

Figure 20:
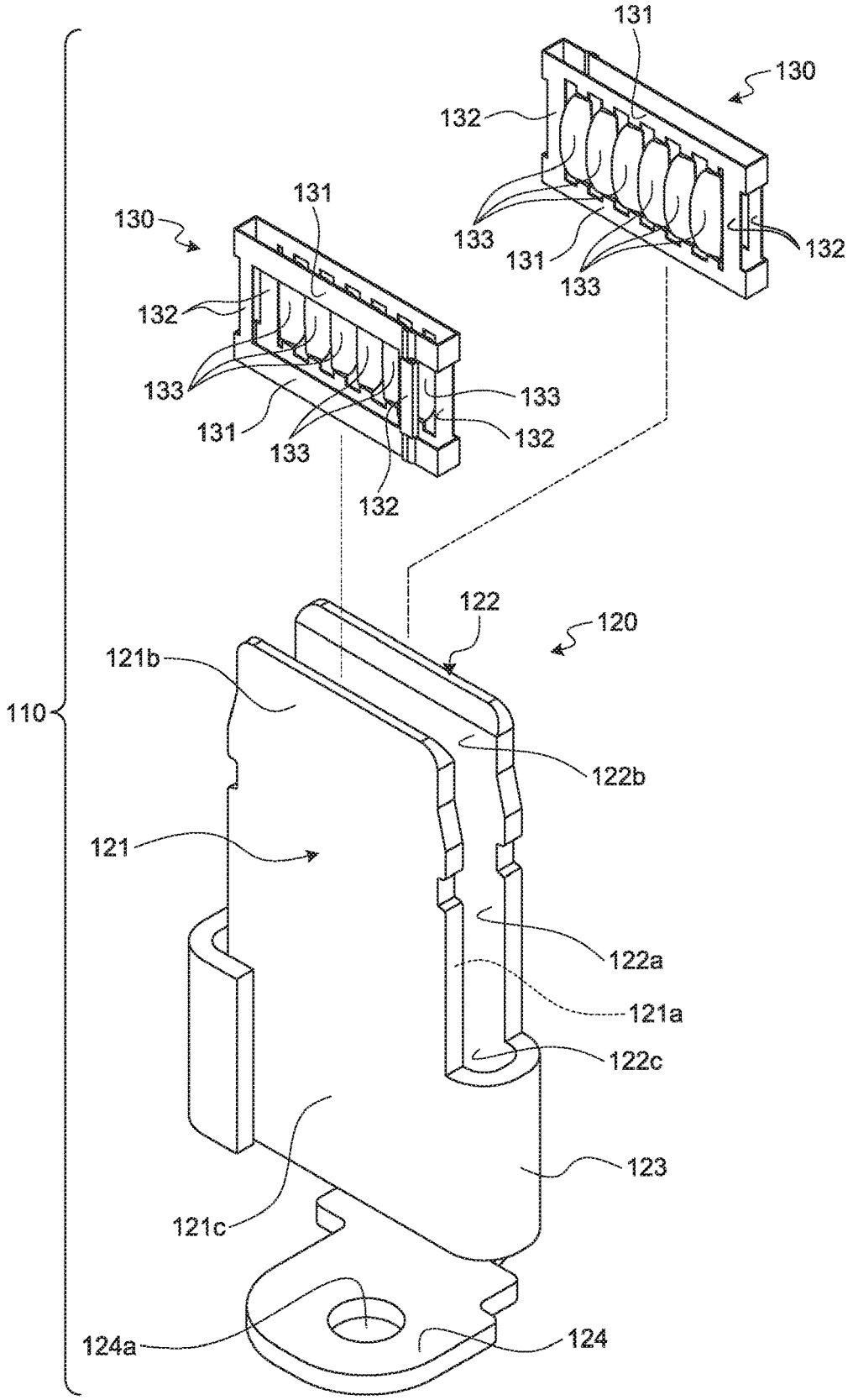
FIG. 20 is an exploded perspective view of the counterpart terminal.
Figure 21:
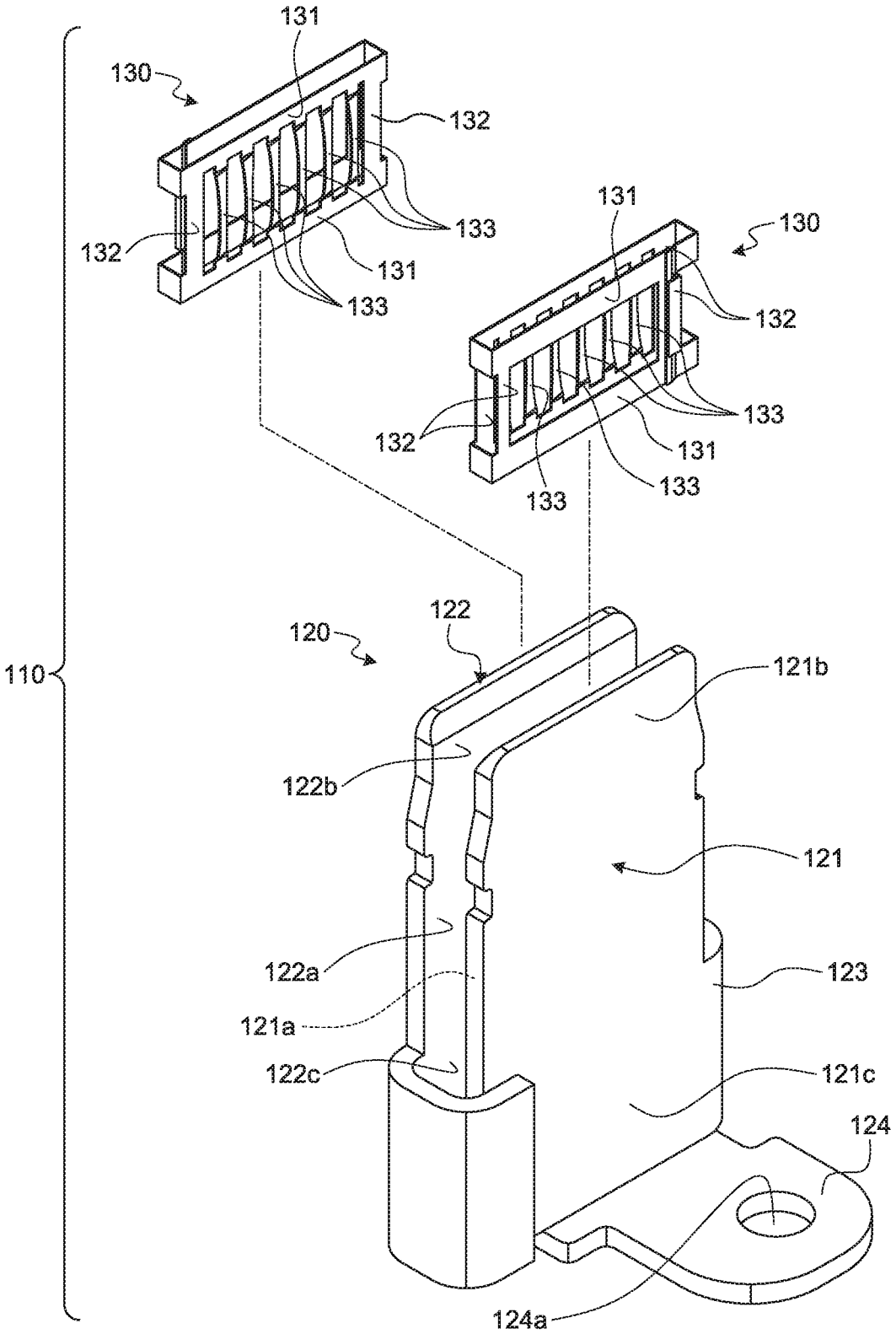
FIG. 21 is an exploded perspective view of the counterpart terminal viewed from a different angle.

The counterpart terminal metal fitting 120 includes the first electrical connection part 121 and the second electrical connection part 122 arranged to be opposed to each other at intervals (FIGS. 20 and 21). Each of the first electrical connection part 121 and the second electrical connection part 122 is formed in a flat plate shape having two flat wall surfaces. In this example, each of the first electrical connection part 121 and the second electrical connection part 122 is formed in a substantially rectangular flat plate shape. The exemplified first electrical connection part 121 and second electrical connection part 122 are formed to have the same shape. In the counterpart terminal metal fitting 120, one of the two wall surfaces of the first electrical connection part 121 and one of the two wall surfaces of the second electrical connection part 122 (hereinafter, referred to as "opposed wall surfaces") 121*a* and 122*a* are arranged to be opposed to each other at intervals (FIGS. 20 and 21). The opposed wall surfaces 121*a* and 122*a* are arranged to be opposed to each other in parallel at intervals.

In the counterpart terminal metal fitting 120, the electrical connection part 11 is inserted into a space between respective end parts 121*b* and 122*b* (FIGS. 20 and 21) of the first electrical connection part 121 and the second electrical connection part 122, and the end parts 121*b* and 122*b* are electrically connected to the inserted electrical connection part 11. The first electrical connection part 121 and the second electrical connection part 122 are formed and arranged so that one of the first wall surface 11*a* and the second wall surface 11*b* of the electrical connection part 11 is arranged to be opposed to one of the opposed wall surfaces 121*a* and 122*a* of the respective end parts 121*b* and 122*b*, and the other one of the first wall surface 11*a* and the second wall surface 11*b* is arranged to be opposed to the other one of the opposed wall surfaces 121*a* and 122*a*. That is, the first electrical connection part 121 and the second electrical connection part 122 are formed and arranged so that the first wall surface 11*a* and the second wall surface 11*b* may be arranged to be opposed to any of the opposed wall surfaces 121*a* and 122*a*. In this example, the opposed wall surfaces 121*a* and 122*a* and the first and the second wall surfaces 11*a* and 11*b* are arranged to be opposed to each other in parallel.

In a case in which the counterpart terminal metal fitting 120 utilizes itself as a contact with the electrical connection part 11, a contact part (not illustrated) is arranged in each of the first electrical connection part 121 and the second electrical connection part 122. In this case, the first electrical connection part 121 includes, as a contact part, a bulging part bulging from the opposed wall surface 121*a* of the end part 121*b* toward the opposed wall surface 122*a* of the second electrical connection part 122. The second electrical connection part 122 includes, as a contact part, a bulging part bulging from the opposed wall surface 122*a* of the end part 122*b* toward the opposed wall surface 121*a* of the first electrical connection part 121. Each of the contact parts has a spherical surface to be a contact, for example, and the contact parts are arranged to be opposed to each other at intervals in a direction orthogonal to the respective opposed wall surfaces 121*a* and 122*a*. The interval between the contact parts is set to be smaller than the plate thickness of the electrical connection part 11. Thus, by inserting the electrical connection part 11 into a space between the first electrical connection part 121 and the second electrical connection part 122, the respective contact parts can be brought into contact with the first wall surface 11*a* and the second wall surface 11*b* of the electrical connection part 11. Accordingly, the first electrical connection part 121 and the second electrical connection part 122 are physically and electrically connected to the electrical connection part 11 in the terminal housing chamber 41 of the second housing member 40 of the housing 20.

In the counterpart terminal metal fitting 120, the first electrical connection part 121 is coupled with the second electrical connection part 122 via a coupling part 123 (FIGS. 20 and 21). The coupling part 123 couples side end parts on one side of the other end parts 121*c* and 122*c* of the respective first and the second electrical connection parts 121 and 122.

The counterpart terminal metal fitting 120 includes a part 124 to be fixed that is fixed to a housing 140 described later (FIGS. 20 and 21). The part 124 to be fixed is arranged on any one of the first electrical connection part 121 and the second electrical connection part 122. The exemplified part 124 to be fixed is formed in a piece body shape, and is projected from an end part in the connector inserting and removing direction of the other end part 122*c* of the second electrical connection part 122. In this case, the part 124 to be fixed is projected in a direction orthogonal to the opposed wall surface 122*a* of the second electrical connection part 122. The part 124 to be fixed includes a through hole 124*a* into which a male screw member B1 (described later) is inserted.

On the other hand, in a case of arranging the contact member 130, the contact member 130 is attached to each of the first electrical connection part 121 and the second electrical connection part 122. In the present embodiment, this case is exemplified.

Different contact members 130 may be used for the first electrical connection part 121 and the second electrical connection part 122, or the same contact member 130 may be used for the first electrical connection part 121 and the second electrical connection part 122. In this case, the first electrical connection part 121 and the second electrical connection part 122 share the same contact member 130.

The contact members 130 are attached to the respective end parts 121*b* and 122*b* of the first electrical connection part 121 and the second electrical connection part 122 to be physically and electrically connected to the respective first electrical connection part 121 and the second electrical connection part 122. That is, the counterpart terminal 110 includes a combination of the first electrical connection part 121 and one contact member 130 in a mutual contact state, and a combination of the second electrical connection part 122 and the other contact member 130 in a mutual contact state. Due to this, the contact member 130 can be brought into contact with the first wall surface 11*a* or the second wall surface 11*b* of the electrical connection part 11 that is inserted into a space between the end parts 121*b* and 122*b* of the first and the second electrical connection parts 121 and 122. Thus, the contact member 130 can cause the electrical connection part 11 to be electrically connected to the first electrical connection part 121 and the second electrical connection part 122.

The contact member 130 is formed to have a spring property with a conductive material such as metal (copper, copper alloy, aluminum, aluminum alloy, and the like). In this example, a conductive metal plate is used as a base material, and the contact member 130 is formed by press working such as cutting and bending.

The contact member 130 is formed so that the first electrical connection part 121 and the second electrical connection part 122 are fitted therein. Thus, the contact member 130 is formed in an annular shape or a tubular shape. For example, the exemplified contact member 130 includes two annular parts 131 having an angular tubular shape that are arranged to be opposed to each other at intervals while aligning the tube axis directions thereof, and four coupling parts 132 that couple the annular parts 131 (FIGS. 20 and 21). The end part 121*b* of the first electrical connection part 121 or the end part 122*b* of the second electrical connection part 122 is fitted in the annular part 131. Each coupling part 132 is, for example, arranged at a corner part of the two annular parts 131 to couple corner parts facing each other in the tube axis direction.

The contact member 130 further includes at least one contact part 133 that is projected outward from the annular part 131 and has elasticity between the annular parts 131 (FIGS. 20 and 21). The exemplified contact member 130 includes a plurality of contact parts 133 that are projected in the same direction by an equal projecting amount. Both ends in the tube axis direction of the contact part 133 are coupled to the respective annular parts 131, and a curved surface arranged at the most projecting position at the center in the tube axis direction is caused to be a contact. The contact parts 133 form a virtual plane (not illustrated) by connecting the most projecting positions. The exemplified virtual plane is arranged to be opposed to the respective opposed wall surfaces 121*a* and 122*a* in parallel when the first electrical connection part 121 or the second electrical connection part 122 is fitted in the contact member 130.

In the counterpart connector 101, the first electrical connection part 121 and the second electrical connection part 122 are fitted in the respective contact members 130 so that virtual planes are arranged to be opposed to each other in parallel at intervals. Accordingly, the contact parts 133 of the respective contact members 130 are arranged to be opposed to each other in a direction orthogonal to the respective opposed wall surfaces 121*a* and 122*a* of the first electrical connection part 121 and the second electrical connection part 122. An interval between the virtual planes is caused to be smaller than the plate thickness of the electrical connection part 11. Thus, by inserting the electrical connection part 11 between the contact members 130, the respective contact parts 133 can be brought into contact with the first wall surface 11*a* and the second wall surface 11*b* of the electrical connection part 11. Thus, the first electrical connection part 121 and the second electrical connection part 122 are physically and electrically connected to the electrical connection part 11 via the respective contact members 130 in the terminal housing chamber 41 of the second housing member 40 of the housing 20.

In a case of arranging the contact member 130, each of the first electrical connection part 121 and the second electrical connection part 122 may include the contact part (bulging part) described above, or do not necessarily include the contact part (bulging part) described above. In a case in which each of the first electrical connection part 121 and the second electrical connection part 122 includes the contact part (bulging part), the counterpart connector 101 can cause the counterpart terminal metal fitting 120 to be shared irrespective of presence of the contact member 130. In this case, the contact part (bulging part) is not arranged on the first electrical connection part 121 and the second electrical connection part 122.

The counterpart connector 101 includes the housing 140 that houses the counterpart terminal 110 (FIGS. 1, 18, and 19). The housing 140 includes a housing member 150 (FIGS. 1, 18, and 19) that houses the counterpart terminal 110, and a holding member 160 (FIGS. 18 and 19) that prevents the housed counterpart terminal 110 from falling out from the housing member 150.

The housing member 150 is formed with an insulating material such as a synthetic resin. The housing member 150 includes a first housing body 151 that houses a combination of the first electrical connection part 121 and the one contact member 130, and a second housing body 152 that houses a combination of the second electrical connection part 122 and the other contact member 130 (FIGS. 1, 18, and 19). The first housing body 151 is formed to surround the first electrical connection part 121 and the one contact member 130 in a state in which the opposed wall surface 121*a* and the contact part 133 side of the one contact member 130 are exposed. The second housing body 152 is formed to surround the second electrical connection part 122 and the other contact member 130 in a state in which the opposed wall surface 122*a* and the contact part 133 side of the other contact member 130 are exposed. The first housing body 151 and the second housing body 152 are arranged to be opposed to each other at intervals in a direction orthogonal to the respective opposed wall surfaces 121*a* and 122*a*. The interval therebetween is set to be a size not hindering insertion of the electrical connection part 11 into a space between the contact members 130. In the housing member 150, the pair of the first housing body 151 and the second housing body 152 is arranged for each counterpart terminal 110.

The housing member 150 includes a tubular body 153 the tube axis direction of which is the connector inserting and removing direction, and both ends of which in the tube axis direction are opened (FIGS. 1, 18, and 19). All combinations of the first housing body 151 and the second housing body 152 are extended in the connector inserting direction from an internal space of the tubular body 153, and projected from an opening 153*a* at one end of the tubular body 153 (FIGS. 1 and 18). An insertion port 153*c* for inserting the counterpart terminal 110 is arranged for each counterpart terminal 110 in an opening 153*b* at the other end of the tubular body 153 (FIG. 19). A holding part 153*d* is arranged inside the tubular body 153, the holding part 153*d* that holds the first housing body 151 and the second housing body 152, and holds the counterpart terminal 110 (FIG. 19). The counterpart terminal 110 is fixed to the holding part 153*d* via the male screw member B1 inserted into the through hole 124*a*.

A female screw member N1 to which the male screw member B1 is screwed is inserted into and engaged with the holding part 153*d* (FIG. 19).

Figure 22:
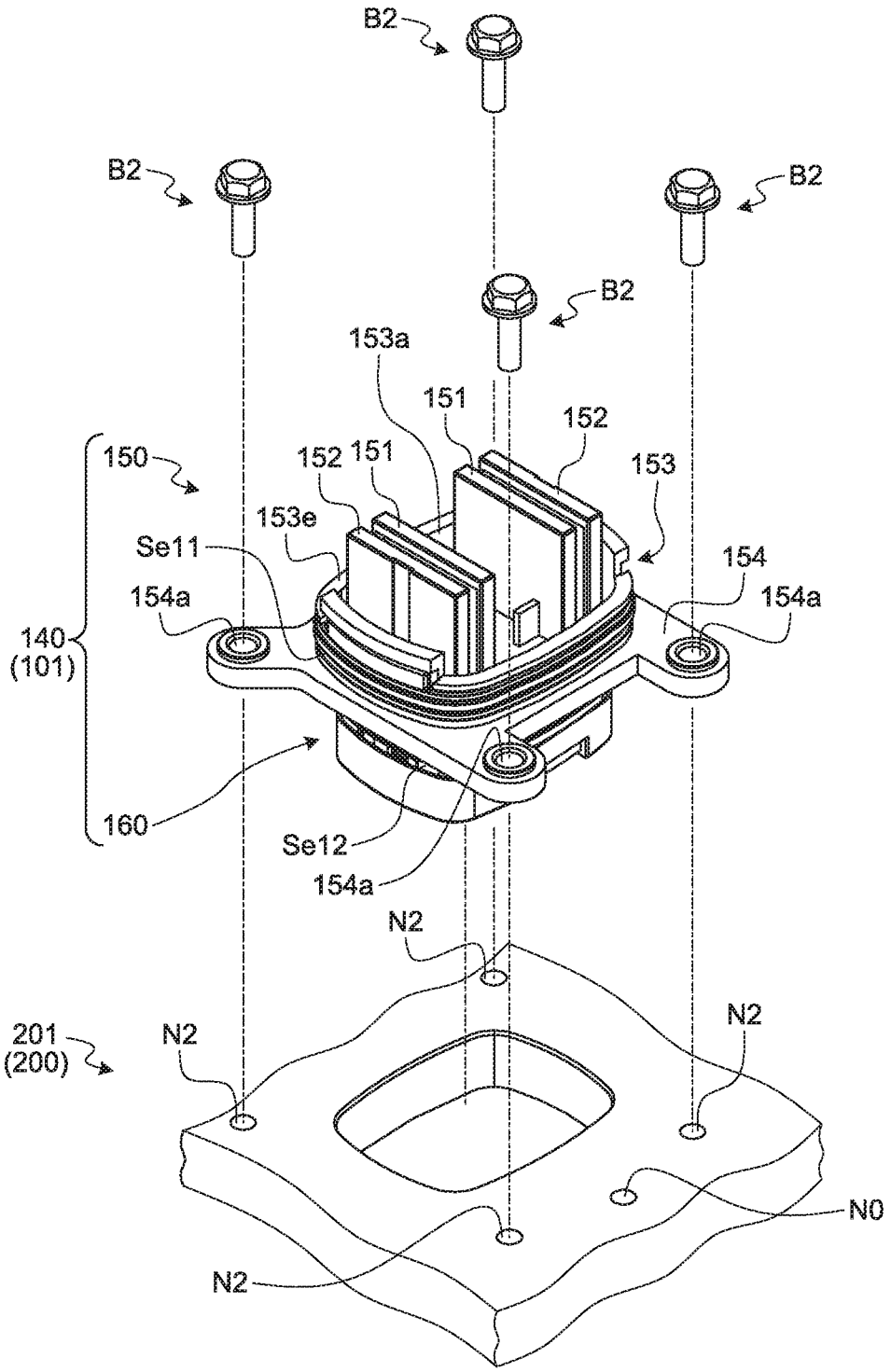
FIG. 22 is a perspective view illustrating the counterpart connector before being attached to a housing of a power supply circuit.

The housing member 150 includes, on an outer side of the tubular body 153, a flange part 154 to be attached to the housing 201 of the power supply circuit 200 (FIGS. 1, 18, and 19). The flange part 154 includes a through hole 154*a* into which the male screw member B2 is inserted (FIG. 22), and is fixed to the housing 201 via the male screw member B2 (FIG. 1). A female screw part N2 to which the male screw member B2 is screwed is formed in the housing 201 (FIG. 22).

A part of the tubular body 153 on the connector inserting direction side with respect to the flange part 154 (that is, a part projecting from the housing 201) is the engagement part (connector engagement part) 153*e* with the connector engagement part 31*a* of the housing 20 in the connector 1 (FIGS. 1, 18, and 19). An annular sealing member Se11 is attached to an outer peripheral surface of the connector engagement part 153*e*. The connector engagement part 153*e* is inserted into and engaged with the connector engagement part 31*a*. The sealing member Se11 is interposed between the connector engagement part 31*a* and the connector engagement part 153*e*, and brought into intimate contact with wall surfaces thereof. On the other hand, a part of the tubular body 153 on the connector removing direction side with respect to the flange part 154 (that is, a portion buried in the housing 201) is an engagement part 153*f* with the holding member 160 (FIGS. 18 and 19).

The holding member 160 is formed with an insulating material such as a synthetic resin. The holding member 160 is engaged with the engagement part 153*f* on the opening 153*b* side on the other end of the tubular body 153, and blocks the insertion port 153*c* of the counterpart terminal 110. The engagement part 153*f* is inserted into and engaged with the holding member 160. The holding member 160 is an engagement part with the housing 201 in the counterpart connector 101. Thus, an annular sealing member Se12 is attached to an outer peripheral surface of the holding member 160 (FIGS. 18 and 19).

The counterpart connector 101 is configured as described above.

Figure 23:
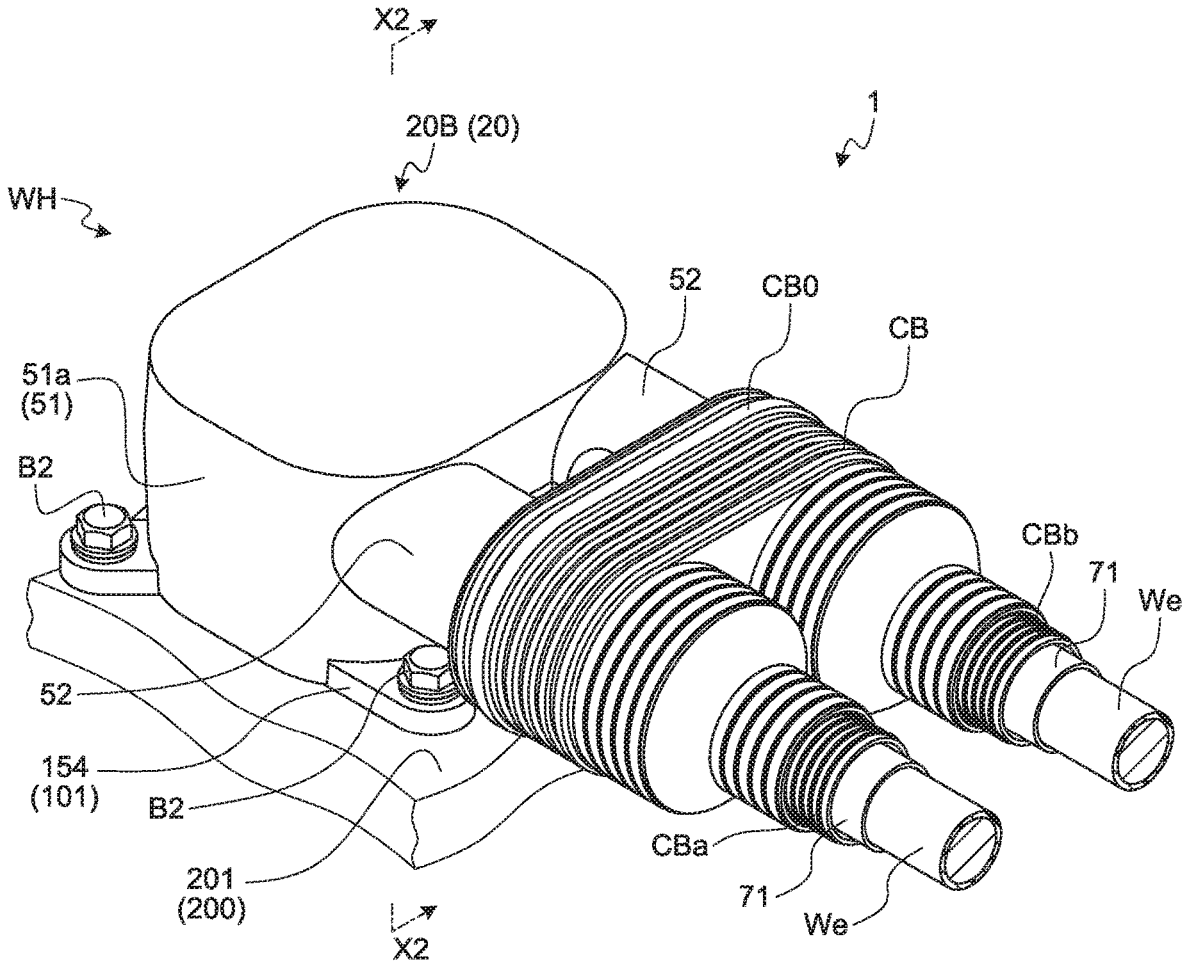
FIG. 23 is a perspective view illustrating the connector and the electric wire with a connector according to the embodiment together with the counterpart connector after connector engagement.
Figure 24:
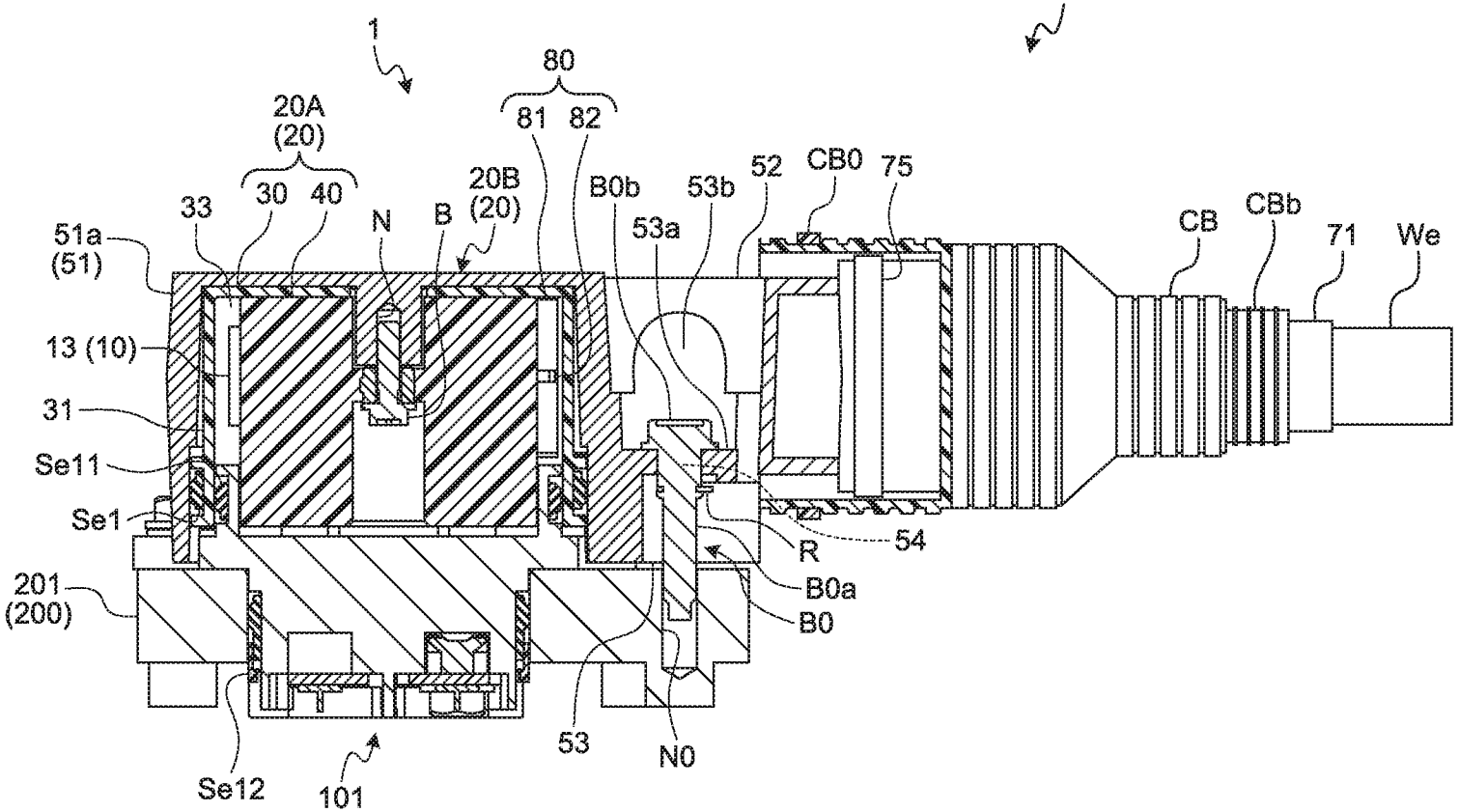
FIG. 24 is a cross-sectional view along the line X2-X2 in FIG. 23.

As described above, the connector 1 is inserted into and engaged with the counterpart connector 101 to be electrically connected thereto (FIGS. 23 and 24). To keep an engaged state with the counterpart connector 101 (that is, an electrically connected state with the counterpart connector 101), the connector 1 according to the present embodiment is screwed to the housing 201 to be fixed. In this example, by screwing the shield shell 20B to the housing 201 made of a conductive material such as metal to be fixed, the connector 1 is fixed to the housing 201, and the shield shell 20B and the second shielding member 71 are electrically connected to the housing 201. The housing 201 is grounded.

The exemplified connector 1 utilizes the coupling body 53 of the shield shell 20B as a holding body for fixing the shield shell 20B to the housing 201. The exemplified shield shell 20B includes the coupling body 53 interposed between the two sub-shield bodies 52, and is fixed to the housing 201 via the coupling body 53.

For example, the coupling body 53 includes the through hole 54 into which a screw part B0*a* of a male screw member B0 (FIGS. 1 and 24) is inserted (FIGS. 3 and 24). The through hole 54 has an axis in the tube axis direction of the outer peripheral wall 51*a* of the main shield body 51, and is formed on a piece-shaped part 53*a* of the coupling body 53 (FIG. 24). A wall surface of the piece-shaped part 53*a* constitutes a seat surface of a head part B0*b* of the male screw member B0. In this example, a locking member R such as a C-ring is attached to the screw part B0*a* side of the male screw member B0 to interpose the piece-shaped part 53*a* between itself and the head part B0*b* (FIGS. 1 and 24). By interposing the piece-shaped part 53*a* between the head part B0*b* and the locking member R, the male screw member BO is assembled to the coupling body 53 in a pivotable manner about the axis. On the other hand, a female screw part NO is arranged in the housing 201 (FIGS. 1, 22, and 24). In this example, the male screw member B0 is screwed to the female screw part N0 in a state in which the connector 1 is completely engaged with the counterpart connector 101. Accordingly, the connector 1 can keep an engaged state with the counterpart connector 101 (an electrically connected state with the counterpart connector 101). The coupling body 53 includes a working space 53*b* for inserting a tool such as a socket into the head part B0*b* and rotating the head part B0*b* about the axis with the tool (FIG. 24).

In the connector 1 according to the present embodiment described above, each electric wire We is individually covered with the second shielding member 71. Accordingly, the connector 1 can prevent thermal interference from being generated between the electric wires We, so that the diameter of each electric wire We can be prevented from being increased. Thus, the connector 1 can cause each electric wire We to have elasticity. In this connector 1, the second shielding member 71 also has elasticity. Thus, the connector 1 according to the present embodiment can improve a degree of freedom of the routing path of each electric wire We. Specifically, in a case of adapting the connector 1 for a higher current, physical constitution of the terminal metal fitting 10 and the counterpart terminal 110 becomes large, and the diameter of the electric wire We is required to be increased accordingly. Even in such a case, the connector 1 according to the present embodiment can prevent the diameter of the electric wire We from being increased as much as possible, so that a degree of freedom of the routing path of each electric wire We can be improved. In the connector 1, the electric wires We are not tied up in a bundle in the first place, so that a degree of freedom of the routing path of each electric wire We can be improved.

In the connector 1 according to the present embodiment, as a degree of freedom of the routing path of the electric wire We is improved, pulling force in a direction of being pulled out from the sub-shield body 52 may be generated in the second shielding member 71. However, in the connector 1, as described above, even when the binding band 75 moves in the tube axis direction relatively to the sub-shield body 52 together with the second shielding member 71, the binding band 75 is locked by the end faces 56*a* of the first and the second locking bodies 56A and 56B. Accordingly, the connector 1 according to the present embodiment can improve a degree of freedom of the routing path of each electric wire We without deteriorating shield performance.

In the connector 1 according to the present embodiment, a combination of the terminal metal fitting 10, the electric wire We, the terminal housing chamber 41, the notch part 42, the terminal insertion port 43, the communication chamber 44, the contact prevention part 45, the terminal holding part 46, the sub-shield body 52, the holding member 20C, the second shielding member 71, and the insulating cylinder 80 is arranged for each number of poles. That is, in the connector 1, the combination may be prepared corresponding to the number of poles. Thus, the connector 1 adapted for a larger number of poles can be easily designed.

The various effects described above can be similarly obtained with the electric wire WH with a connector including the connector 1.

In the connector and the electric wire with a connector according to the present embodiment, each electric wire is individually covered with the second shielding member. Accordingly, the connector and the electric wire with a connector can prevent thermal interference from being generated between the electric wires, so that the diameter of each electric wire can be prevented from being increased. Thus, the connector and the electric wire with a connector can cause each electric wire to have elasticity. In the connector and the electric wire with a connector, the second shielding member also has elasticity. Accordingly, the connector and the electric wire with a connector according to the present invention can improve a degree of freedom of the routing path of each electric wire. Additionally, in the connector and the electric wire with a connector according to the present invention, the electric wires are not tied up in a bundle in the first place, so that a degree of freedom of the routing path of each electric wire can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a terminal metal fitting that includes an electrical connection part to be electrically connected to a counterpart terminal of a counterpart connector and an electric wire connection part to be electrically connected to a terminal of an electric wire;

a housing body that is insulative, houses the electrical connection part in an inward housing space, and causes the electric wire connection part to project outward;

a first shielding member that is conductive and includes a main shield body that covers the housing body from the outside, a sub-shield body having a tubular shape that covers the electric wire connection part and the terminal of the electric wire from the outside for each terminal metal fitting, and a second sub-shield body; and a second shielding member and another second shielding member each having a tubular shape, electrical conductivity, and elasticity and the second shielding member covers, from the outside, an end part on an opening side of the sub-shield body together with the electric wire pulled out from the opening, wherein the second shielding member and the another second shielding member are connected to ones of the sub-shield body and the second sub-shield body.

2. The connector according to claim 1, further comprising:

a binding member that is wound around the second shielding member and the end part on the opening side of the sub-shield body over the second shielding member to fix the second shielding member to the end part on the opening side of the sub-shield body, wherein the sub-shield body includes a locking body that projects from an outer peripheral surface of the end part on the opening side, and the binding member having an annular shape after winding is arranged to be opposed to an end face on the main shield body side of the locking body in a tube axis direction of the sub-shield body.

3. The connector according to claim 2, further comprising:

a holding member that prevents, on the electric wire side, the terminal metal fitting from falling out from the housing body, wherein the holding member has a cylindrical outer peripheral wall to which the end part on the opening side of the sub-shield body having a cylindrical shape is fitted, and is formed to be able to pull out, to the outside, the electric wire routed in a housing space inside the sub-shield body, the outer peripheral wall includes a gap into which the locking body is inserted in a state in which the holding member is engaged with the end part on the opening side of the sub-shield body, and the locking body and the gap are formed and arranged to be able to prevent relative rotation in a circumferential direction of the sub-shield body and the holding member.

4. An electric wire with a connector comprising:

an electric wire;

a terminal metal fitting that includes an electrical connection part to be electrically connected to a counterpart terminal of a counterpart connector and an electric wire connection part to be electrically connected to a terminal of the electric wire;

a housing body that is insulative, houses the electrical connection part in an inward housing space, and causes the electric wire connection part to project outward;

a first shielding member that is conductive and includes a main shield body that covers the housing body from the outside, a sub-shield body having a tubular shape that covers the electric wire connection part and the terminal of the electric wire from the outside for each terminal metal fitting, and a second sub-shield body; and a second shielding member and another second shielding member each having a tubular shape, electrical conductivity, and elasticity and the second shielding member covers, from the outside, an end part on an opening side of the sub-shield body together with the electric wire pulled out from the opening wherein the second shielding, member and the another second shielding member are connected to ones of the sub-shield body and the second sub-shield body.

5. A connector comprising:

a terminal metal fitting that includes an electrical connection part to be electrically connected to a counterpart terminal of a counterpart connector and an electric wire connection part to be electrically connected to a terminal of an electric wire;

a housing body that is insulative, houses the electrical connection part in an inward housing space, and causes the electric wire connection part to project outward;

a first shielding member that is conductive and includes a main shield body that covers the housing body from the outside, and a sub-shield body having a tubular shape that covers the electric wire connection part and the terminal of the electric wire from the outside for each terminal metal fitting;

a second shielding member having a tubular shape, electrical conductivity, and elasticity that covers, from the outside, an end part on an opening side of the sub-shield body together with the electric wire pulled out from the opening;

a binding member that is wound around the second shielding member and the end part on the opening side of the sub-shield body over the second shielding member to fix the second shielding member to the end part on the opening side of the sub-shield body; and a holding member that prevents, on the electric wire side, the terminal metal fitting from falling out from the housing body, wherein the sub-shield body includes a locking body that projects from an outer peripheral surface of the end part on the opening side, and wherein the binding member having an annular shape after winding is arranged to be opposed to an end face on the main shield body side of the locking body in a tube axis direction of the sub-shield body, wherein the holding member has a cylindrical outer peripheral wall to which the end part on the opening side of the sub-shield body having a cylindrical shape is fitted, and is formed to be able to pull out, to the outside, the electric wire routed in a housing space inside the sub-shield body, wherein the outer peripheral wall includes a gap into which the locking body is inserted in a state in which the holding member is engaged with the end part on the opening side of the sub-shield body, and wherein the locking body and the gap are formed and arranged to be able to prevent relative rotation in a circumferential direction of the sub-shield body and the holding member.

* * * * *